US006823995B2

(12) United States Patent
Mukai

(10) Patent No.: US 6,823,995 B2
(45) Date of Patent: Nov. 30, 2004

(54) PAPER PROCESSING DEVICE

(75) Inventor: Masanori Mukai, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/068,843

(22) Filed: Feb. 11, 2002

(65) Prior Publication Data

US 2002/0074267 A1 Jun. 20, 2002

Related U.S. Application Data

(63) Continuation of application No. PCT/JP99/06647, filed on Nov. 29, 1999.

(51) Int. Cl.[7] ..... B07C 5/00; G07F 7/04
(52) U.S. Cl. ..... 209/534; 194/207
(58) Field of Search ..... 209/534, 900; 194/200, 207; 902/15, 16

(56) References Cited

U.S. PATENT DOCUMENTS 5,019,249 A * 5/1991 Sugai et al. ..... 209/534
5,450,937 A * 9/1995 Ono et al. ..... 194/203
5,734,958 A * 3/1998 Kazama et al. ..... 271/3.15
2002/0096299 A1 * 7/2002 Mukai ..... 162/262

FOREIGN PATENT DOCUMENTS

| | | | |
|---|---|---|---|
| JP | 63-45694 | 2/1988 | |
| JP | 63-262790 | 10/1988 | |
| JP | 01-250050 | 10/1989 | |
| JP | 02-295836 | 12/1990 | |
| JP | 05-324984 | 12/1993 | |
| JP | 06-93273 | 11/1994 | |
| JP | 08087370 A * | 4/1996 | ..... G06F/3/03 |
| JP | 09-71363 | 3/1997 | |
| JP | 11-102456 | 4/1999 | |

* cited by examiner

*Primary Examiner*—Donald P. Walsh
*Assistant Examiner*—Joseph C Rodriguez

(57) ABSTRACT

A paper processing device that discriminates papers such as bills and the like while transferring, and changes the transfer routes of the papers according to the discriminating result. More particularly, a device that is built in an automatic teller machine that carries out transactions such as receipt of money, payment of money and the similar, and thereby processes bills, and aims at reducing the number of stop failures, and at detection of paper powder at a level that does not cause any transfer trouble, transfers bills as they are, and handles those bills that have been transferred until paper powder is removed in the same manner as for abnormally shaped bills.

12 Claims, 18 Drawing Sheets

PAPER PROCESSING DEVICE

This application is a continuing application, filed under 35 U.S.C. §111(a), of International Application PCT/JP99/06647, filed Nov. 29, 1999, it being further noted that foreign priority benefit is based upon International Patent Application PCT/JP99/06647, filed Nov. 29, 1999.

TECHNICAL FIELD

The present invention relates to a paper processing device that transfers as well as discriminates papers such as bills and the like while transferring, and changes the transfer routes of papers according to the discriminating result, and more particularly to a device that is built in an automatic teller machine (hereinafter shortly referred to as "ATM") that carries out transactions such as receipt of money, payment of money and the similar, and thereby processes bills.

BACKGROUND ART

In an ATM, optical sensors and magnetic sensors and the similar are arranged in its discriminating portion, and dimensions of papers that go through the discriminating portion, patterns and shading and the like of bills are detected and compared with a dictionary prepared in advance, thereby whether a bill is genuine or not is discriminated.

In such a discriminating portion of ATM, generally, an optical line sensor wherein multiple optical sensor devices are arranged in the direction crossing the passing direction of a bill that passes there is arranged, but when paper powder or a paper chip remains on the line sensor, sensor device output becomes faulty, which may lead to failure in correct detection on a bill that is to be transferred in next time and may cause a wrong discriminating result, or if the size of such residue is rather large, it may become an obstacle in transfer and cause transfer failure, or sensor devices may be considered to have been deteriorated, as a result, the emission light amount of light source that radiates light onto a bill in the case of the detection by the line sensor may be increased to excess, which has become problems.

Then, conventionally, countermeasures are taken such that, before the start of one transaction (receipt of money, payment of money and the similar), the output conditions of the line sensor are checked out, and if there is a faulty output, then the transaction is suspended.

However, according to the conventional methods, even when, for example, paper powder or a small paper chip (hereinafter represented by paper powder) which does not cause any transfer failure remains and the output of a sensor device configuring the line sensor is faulty, the transaction stops, therefore, in machines that often handle bills that have been circulated for a certain period, the number of stop failures owing to paper powder extremely increases, which has become another problem.

DISCLOSURE OF THE INVENTION

The present invention has been made in consideration of the above problems, accordingly, the object of the present invention is to provide a paper processing device wherein efforts are made so as to decrease stop failures.

A paper processing device of the present invention to achieve the above object is a paper processing device which comprises a discriminating portion to sense papers passing by a specified sensor, and by carrying out a discriminating process according to the result of the sensing to apply one of discriminating results plurally classified to the sensed papers, and wherein, in every process, one paper or more to be objectives of the one process is transferred one by one along a transfer route that passes through the discriminating portion, and a transfer route of each paper after passing through the discriminating portion is changed according to discriminating results at the discriminating portion, the paper processing device comprising, a sensor output abnormality detecting portion that carries out a detecting process to detect that the output of the sensor is in a specified abnormal status according to the output of the sensor before the start of one process, and when the specified abnormal status is detected in the detecting process conducted before the start of the one process, further carries out a detecting process to detect the output of the sensor also after the start of the one process, and a transfer control portion that starts the one process even when either of the specified abnormal status or normal status is detected in the initial detecting process conducted before the start of the one process by the sensor output abnormality detecting portion, and in the case where the specified abnormal status is detected in the initial detecting process, transfers papers that pass through the discriminating portion after the start of the one process until normal status is detected in the detecting process of the sensor output carried out after the start of the one process, along a transfer route corresponding to the specified abnormal status after they pass through the discriminating portion.

Paper powder (including a paper chip) left in the discriminating portion is transferred, while some papers are passing, with attached to the papers passing, or goes out of the view of the sensor.

A paper processing device according to the present invention is so made as to start paper transfer even when a specified abnormal status, for example when a sensor output abnormal status, to an extent that any transfer trouble is not caused, is detected. As a consequence, according to a paper processing device of the present invention, it is possible to greatly reduce the number of stop failures.

In a paper processing device according to the present invention, in the case where paper transfer is started though a sensor output abnormal status has been detected, papers that are transferred until the sensor output is recovered to normal status thereafter are transferred along a transfer route corresponding to such papers, thereby, it is possible to process these papers in manner as is different from the process for papers in normal status.

Herein, in the paper processing device according to the present invention, it is preferable that the discriminating portion carries out a discriminating process including a discriminating result that the paper is abnormal as one of the discriminating results, and the transfer control portion transfers, in the case where the specified abnormal status is detected in the initial detecting process conducted before the start of one process by the sensor output abnormality detecting portion, papers that pass through the discriminating portion after the start of the one process until normal status is detected in the detecting process carried out after the start of the one process, along the same transfer route as the case wherein discriminating result that the paper is abnormal is obtained at the discriminating portion.

As mentioned above, at the moment when sensor output is abnormal owing to paper powder and the like, it is possible to handle papers that have passed through the discriminating portion in the same manner as when the discriminating portion obtains that papers are abnormal, without setting a separate transfer route.

In the paper processing device according to the present invention, it is preferred that the paper processing device further comprises a pool portion for storing papers that have been transferred along the transfer route corresponding to the specified abnormal status, and the transfer control portion transfers again papers stored in the pool portion, after the sensor output abnormality detecting portion detects normal status, along the transfer route that passes through the discriminating route.

In this case, papers stored in the pool portion may be taken out from the pool portion and transferred again in the one process wherein they are stored in the pool portion, or may be stored in the pool portion in the one process, and papers stored in the pool portion may be transferred again in the next process.

Papers that pass through the discriminating portion when the sensor output is in an abnormal status cannot be discriminated correctly, accordingly, they are handled apart from normal papers, in the same manner as for abnormal papers for example, however, almost all of such papers are actually normal papers. Therefore, they are stored in the pool portion and transferred again as described above, thereby effective use of resources of papers in a device can be made.

Herein, in the paper processing device according to the present invention, the sensor output abnormality detecting portion may carry out the detecting process of the sensor output before the start of one process, and when a specified abnormal status is detected in the detecting process carried out before the start of the one process, it may carry out a detecting process at every time when one of papers to be objectives of the one process passes through the discriminating portion, after the start of the one process, and until the number of papers that pass through the discriminating portion reaches a specified one, and until normal status is detected by the sensor output abnormality detecting portion, or the sensor output abnormality detecting portion may carry out the detecting process of the sensor output before the start of one process, and when a specified abnormal status is detected in the detecting process carried out before the start of the one process, it may start the one process and carry out a detecting process after a specified number of papers to be objectives of the one process has passed through the discriminating portion.

At every time when one paper passes through the discriminating portion, it is detected whether sensor output has returned to normal status or not, thereby it is possible to minimize the number of papers on which a correct discrimination cannot be made at the discriminating portion. While, in the case where it is detected whether sensor output has returned to normal status after a specified number of papers is made to pass through the discriminating portion, thereby it is possible to transfer the specified number of papers continuously, as a result, it is possible to facilitate the speed of processing.

Further, in the paper processing device according to the present invention, it is also a preferred embodiment wherein it is enabled to freely transfer mock papers different from papers to be objectives of processing along a transfer route passing through the discriminating portion, and the transfer control portion starts one process after a specified abnormal status is detected in the detecting process carried out before the start of one process by the sensor output abnormality detecting portion, and when it is detected that sensor output is still not back to normal status even in the detecting process carried out at a specified moment after the start of the one process, the transfer control portion suspends the transfer of papers after the specified moment among papers to be objectives of the one process, and transfers mock papers along a transfer route passing through the discriminating portion, and the sensor output abnormality detecting portion carries out detecting process also after mock papers have passed through the discriminating portion.

By preparation of mock papers with adjusted materials and dimensions, paper powder and the similar are easily removed from the sensor position in comparison with papers to be objectives of normal processing. Accordingly, in the case where the sensor output will not get back to normal even after a specified number of normal papers is made to pass, it is preferable to pass mock papers and to remove paper powder and the like.

Herein, in the paper processing device according to the present invention, it is preferable that the sensor is typically a line sensor comprising plural sensor devices arranged in width direction crossing the paper passing direction at the discriminating portion, and in this case, the sensor output abnormality detecting portion detects that the output of a specified number or less of the sensor devices among the plural sensor devices is faulty as the specified abnormal status.

Thanks to the structure as mentioned above, it is possible to discriminate the case where a large paper chip or a paper itself that may cause transfer problem remains in the discriminating portion and the case where paper powder and the similar remains there, and thereby to carry out processing to remove paper powder and the similar as mentioned above only when there is no fear of transfer problem.

Still further, in the paper processing device according to the present invention, it is a preferred embodiment wherein the sensor output abnormality detecting portion carries out detecting processing wherein the specified abnormal status is further divided into a specified first abnormal status and a specified second abnormal status, for at least a detecting process to be carried out before the start of one process, and also carries out the detecting process of the sensor output also after the mock papers pass through the discriminating portion, and the transfer control portion starts one process when either the first abnormal status among the specified abnormal statuses or normal status is detected in the initial detecting process carried out before the start of one process by the sensor output abnormality detecting portion, while when the second abnormal status among the specified abnormal statuses is detected in the initial detecting process, prior to the start of the one process, the transfer control portion transfers the mock papers along transfer route passing through the discriminating portion.

By judging whether paper powder and the similar can be removed by normal papers or whether it is better to pass mock papers, according to the conditions of faulty output, papers or mock papers are transferred according to such judgement, thereby it is possible to remove paper powder and the similar in more secured manners.

In this case, mock papers may be longer in the width direction crossing transfer direction than papers to be objectives of processing, the sensor may be a line sensor comprising plural sensor devices arranged even to the position exceeding the passing area of papers to be objectives of processing, in the width direction crossing the passing direction of papers at the discriminating portion, and the sensor output abnormality detecting portion may detect that the output of a specified number or less of the sensor devices among the plural sensor devices is faulty as a specified abnormal status, and detect the status wherein all the sensor devices with faulty output are sensor devices in the passing area of papers to be objectives of processing as a first abnormal status among the specified abnormal statuses, and also detects the status wherein sensor devices out of the passing area are included in the sensor devices with faulty output as a second abnormal status among the specified abnormal statuses.

When it is expected that there exists paper powder and the like on a position where they may be removed with normal papers, then normal papers are made to pass, thereby it is possible to facilitate the speed of processing higher, and also to avoid unnecessary use of mock papers as much as possible.

As mentioned heretofore, according to a paper processing device of the present invention, it is possible to significantly reduce the number of stop failures.

BRIEF DESCRIPTION OF THE DRAWINGS

FIG. 1 is a perspective view showing an external appearance of an ATM wherein a paper processing device according to the present invention is built in.

BEST MODE FOR CARRYING OUT THE INVENTION

The embodiments of the present invention will be described below.

Figure 1:
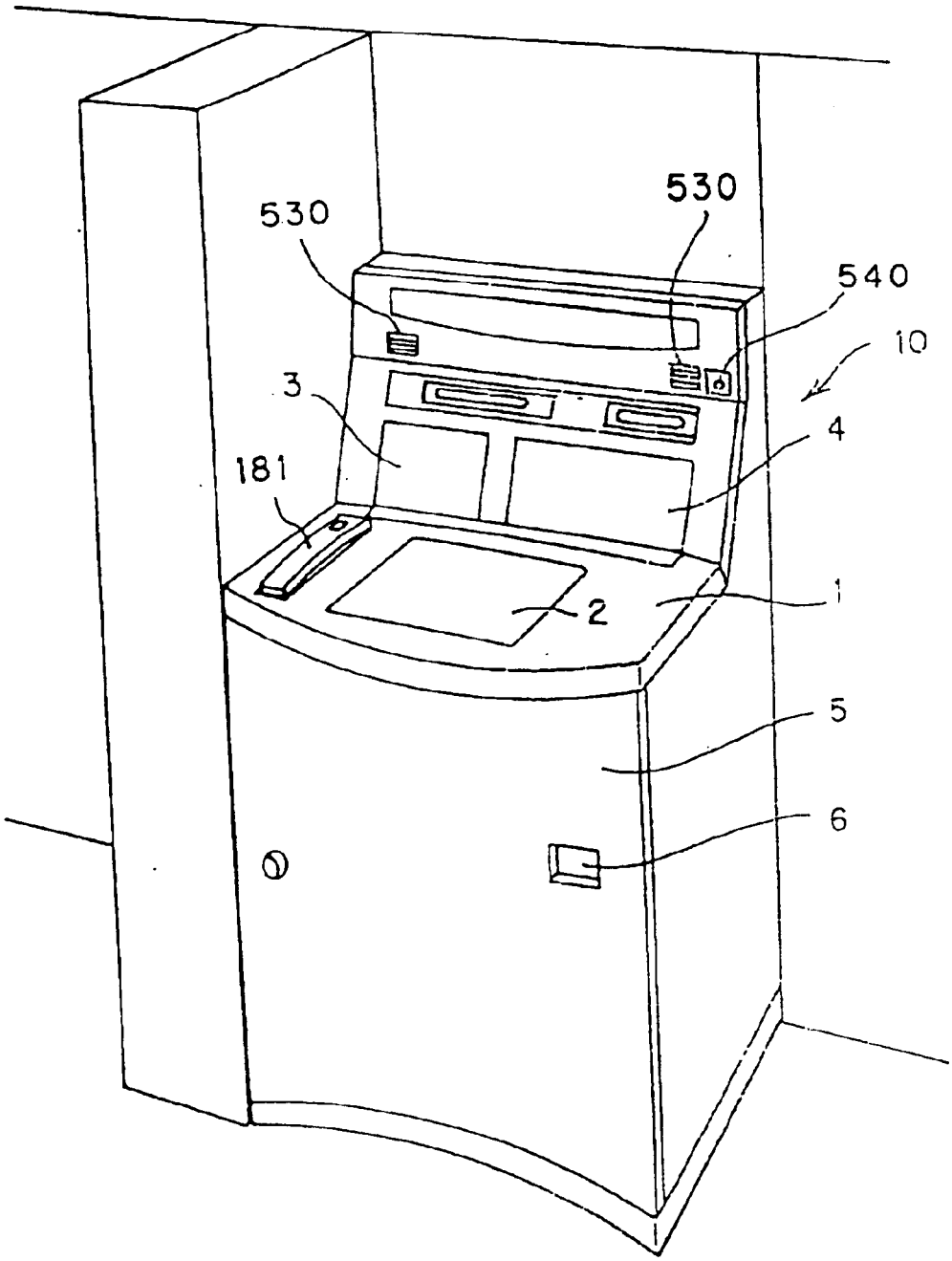

FIG. 1 is a perspective view showing an external appearance of an ATM wherein a paper processing device according to the present invention is built in.

On a console panel 1 of this ATM 10, there is an operation display portion 2 comprising a color display and a transparent touch keyboard superposed on the color display, and a customer standing in front of this ATM 10 touches the operation display portion 2 with the finger according to the display contents displayed on the operation display portion 2 and the contents of the transaction that he or she wants to do, and by this operation of touching the touch key board with the finger, the transaction is carried out.

Behind the console panel 1, there are a coin charge port 3 and a bill charge port 4 that open and close for charging coins and bills, and a coin return port 6 for returning coins is arranged on a front door 5 which is normally locked at the bottom of the console panel 1.

At the further top portion above the coin charge port 3 and the bill charge port 4, there are a couple of speakers 530 and 530 for telling an audio message to customers, and at the position adjacent to one of these speakers 530, there is a call button 540 for calling for clerks in the case of any trouble.

Figure 2:
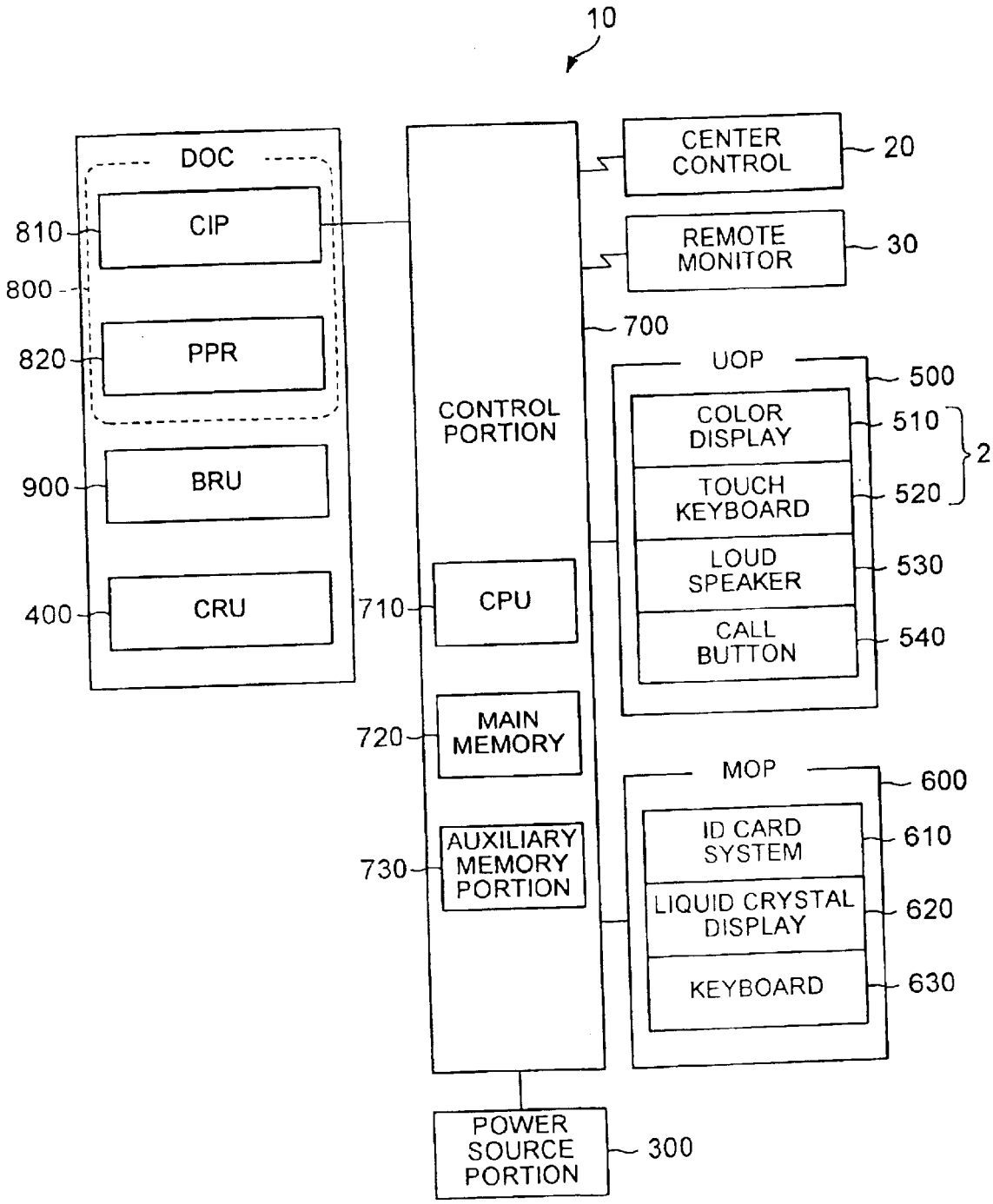
FIG. 2 is a block diagram showing an internal structure of the ATM whose external view is shown in FIG. 1.

FIG. 2 is a block diagram showing an internal structure of the ATM whose external view is shown in FIG. 1.

The ATM 10 shown in FIG. 2 comprises a control portion 700, a document output and card reader writer (DOC) 800, a bill recycle unit (BRU) 900, a coin recycle unit (CRU) 400, a user operation portion (UOP) 500, a management operation portion (MOP) 400, a power source portion 300, and the like.

The control portion 700 is a section having the entire control over this ATM 10, and comprises a central processing unit (CPU) 710 for executing programs, a main memory 720 for storing programs to be run by the CPU 710, and an auxiliary memory portion 730 including, for example, a magnetic disk device for containing therein a magnetic disk and driving the magnetic disk, a floppy disk drive device for loading a floppy disk therein and driving the floppy disk and the like.

In this control portion 700, the operation information from a user is received and the delivery of cash with user is controlled, and also the contained cash and the similar are managed. This control portion 700 also receives instructions from a center control 20, and reports the conditions of this ATM to the center control 20. Further, this control portion 700 is connected to a remote monitor 30, which monitors users operating this ATM 10 and the ATM itself from a distance.

The DOC 800 is a portion for handling a cash card and a passbook, and comprises a card reader/writer image reader printer (CIP) 810 that has functions to read contents recorded in a magnetic stripe of a cash card and to record transaction contents into a receipt, and a passbook printer (PPR) 820 that has a function to record data into a passbook.

The BRU 900 is a unit for handling receipt and payment of bills with users (customers) of this ATM, and sorts out and contains bills charged into the ATM 10 by users of the ATM 10 according to denominations of bills, and also carries out payment using the bills sorted and contained in advance, when payment from the ATM 10 to user is carried out. This BRU 900 will be described in detail later.

The CRU 400 is a unit for handling receipt and payment of coins with users (customers) of this ATM.

The UOP 500 is a portion wherein users (customers) of this ATM carry out operations of depositing, withdrawing and the like, and is equipped with the operation display portion 2 (Refer to FIG. 1) comprising a color display 510 for displaying information for users and a touch keyboard 520 for customers inputting their personal identification numbers and money amount and the like, the speakers 530 for giving necessary audio guidance to customers, and the call button 540 for calling for clerks in the case of any trouble.

The MOP 600 is a portion operated by staff members of a financial institution where this ATM is installed, and this MOP 600 is equipped with an ID card system 610 that checks an ID card to confirm authorized operators of the MOP 600 and thereby controls an electromagnetic lock, a liquid crystal display 620 for displaying information for operation, and a keyboard 630 for operation.

Figure 3:
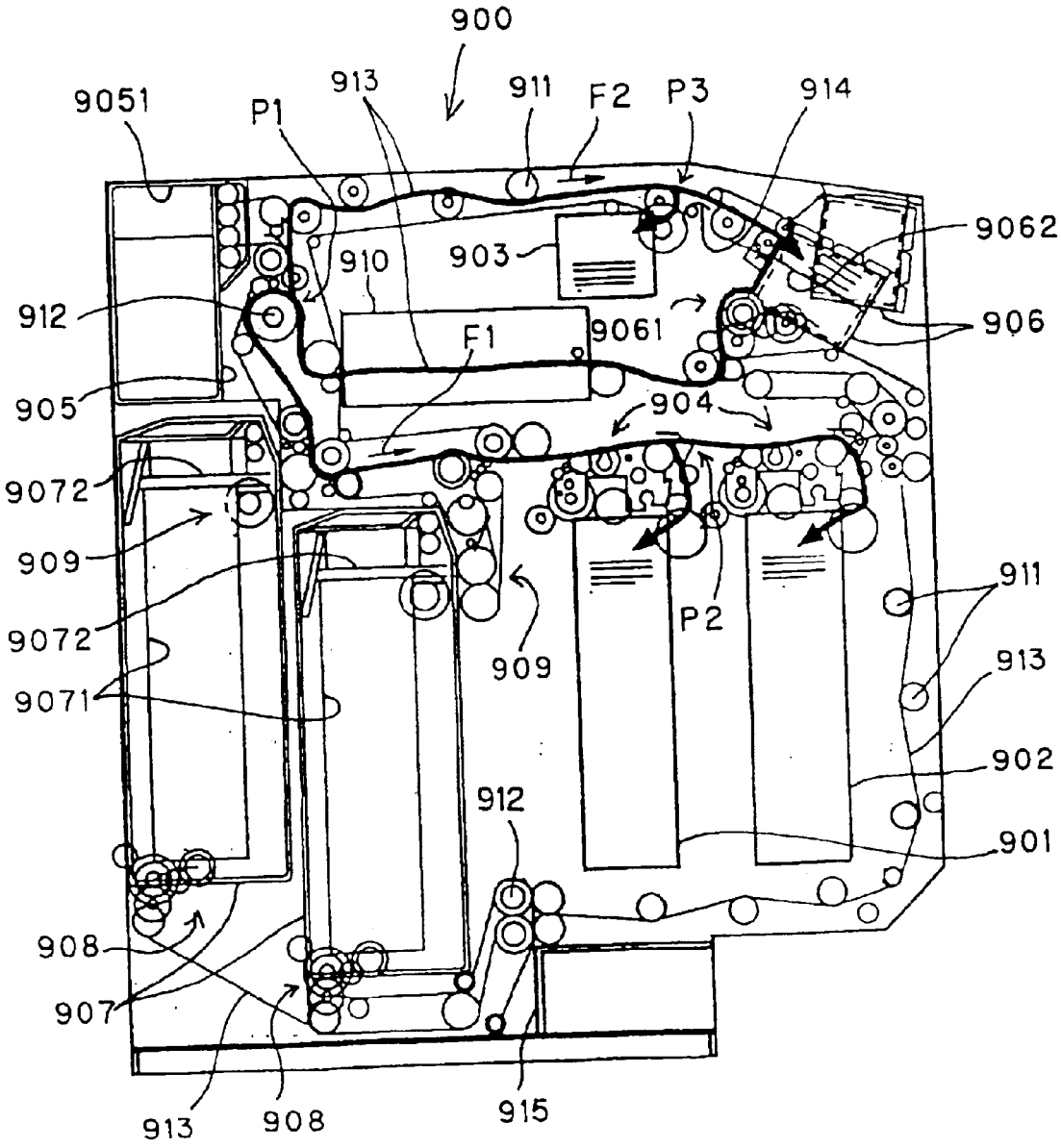
FIG. 3 is a view showing an internal structure of a BRU shown as one block in FIG. 2.

FIG. 3 is a view showing an internal structure of the BRU shown as one block in FIG. 2.

A user of this ATM, positioned at the right side in the figure, charges bills and does other operations. Hereinafter, the right side in the figure may be referred to as "front side", while the left side in the figure may be referred to as "rear side".

This BRU 900 is equipped with a thousand yen bill stacker 901, a ten thousand yen bill stacker 902, a pool portion 903, and a takeout and containing mechanism 904, and bills are sorted according to denominations of bills and contained into these two stackers 901 and 902. To the pool portion 903, five thousand yen bills are contained temporarily. To the stackers 901 and 902, bills are contained by the takeout and containing mechanism 904, while from the stackers 901 and 902, bills are taken out by the takeout and containing mechanism 904. Thousand yen bills and ten thousand yen bills contained in the thousand yen bill stacker 901 and the ten thousand yen bill stacker 902 are used for payment from the ATM to users, and five thousand yen bills contained in the pool portion 903 are not used for payment but are collected.

At the top of the rear side of this BRU 900, a reject box 905 is arranged, wherein abnormally shaped bills are contained. Inside of the reject box 905, a five thousand yen bill room 9051 is arranged, and five thousand yen bills are contained via the pool portion 903 into the five thousand yen bill room 9051.

At the top of the front side of this BRU 900, a charge box 906 that can freely move to two positions, top and bottom, and a takeout mechanism 9061 that takes out bills from the charge box 906 are arranged, and when the charge box 906 is positioned at the top position, bills are charged from the outside of the ATM into the charge box 906 by a user, or bill are taken out to the outside by the user.

When the charge box 906 is positioned at the bottom position, bills to be delivered from the ATM to a user are contained into the charge box 906, or bills are taken from the charge box 906 into the inside of the BRU 900 by the takeout mechanism 9061.

Meanwhile, the inside of the charge box 906 is separated into two space sections by a partition plate 9062, and to one space section of these two space sections, bills charged by users are contained, while to another space section, abnormally shaped bills and the like among bills that have been once taken from the charge box 906 into the BRU 900 are contained.

At the rear side of this BRU 900, two units of a cassette 907 that may be freely attached and detached wherein a bill room 9071 and a reject room 9072 are arranged are provided. At the bottom of each of these cassettes 907, a takeout mechanism 908 for taking out bills from the cassette 907 is arranged, while at the top of each of these cassettes 907, a containing mechanism 909 for containing bills into the cassette 907 is arranged. When the case occurs where managers of the ATM collects bills from the ATM, bills contained in the two stackers 901 and 902 are transferred to and contained into the bill room 9071 in the cassette 907. When the case occurs where bills must be replenished into the ATM by the managers of the ATM, bills contained in the bill room 9071 of the cassette 907 are transferred to and contained into the two stackers 901 and 902. Abnormally shaped bills and the similar that are found while bills are transferred from the cassette 907 to the stackers 901 and 902 are contained into the reject room 9072. Meanwhile, the cassette at the right side among the two cassettes 907 and 907 is a spare cassette, which is used when the quantity of bills contained in the two stackers 901 and 902 exceeds the amount that the cassette at the left side can contain during the collection of bills.

These two cassettes 907 and 907 are also used to contain mock bills that are different from actual authentic bills and are used for checking transfer conditions of bills in this BRU 900, and to feed out the mock bills from the cassettes 907 and 907, and after the mock bills have passed through a specified transfer route, to contain the mock bills into the cassettes 907 and 907. Herein, as these mock bills, the mock bills are employed, whose width direction (bill longitudinal direction) crossing the transfer direction is longer than those of actual bills.

At the place rather above the center of this BRU, a discriminating unit 910 is arranged, and bills are sensed by this discriminating unit 910, and according to the discriminating results, discrimination including the judgment of denomination of bills, and the judgement of authenticity of bills and the like is carried out.

In addition, in this BRU 900, a transfer roller 911, a DC motor 912, and a transfer belt 913 are arranged. The transfer belt 913 is supported by the transfer roller 911 and driven by the DC motor 912, thereby transfers bills from each portion to other respective portions in the BRU 900, and makes bills pass through the inside of the discriminating unit 910. Bill transfer routes will be described in detail later.

The transfer belt 913 also may transfer bills even when slightly inclined to the transfer direction. To correspond to this, the discriminating unit 910 is so structured that it can discriminate even bills that are transferred in slightly inclined status.

In this BRU 900, a gate 914 is arranged at each junction of the transfer route, and thereby the transfer routes are changed by the gate 914. In FIG. 3, only a part of gates among the gates 914 arranged at respective junctions is illustrated, and other gates are omitted.

At the bottom of the BRU 900, a comprehensive control portion 915 is arranged, and each portion of the BRU 900 is controlled by this comprehensive control portion 915. The comprehensive control portion 915 drives the gates 914, and thereby transfer routes are changed.

Figure 4:
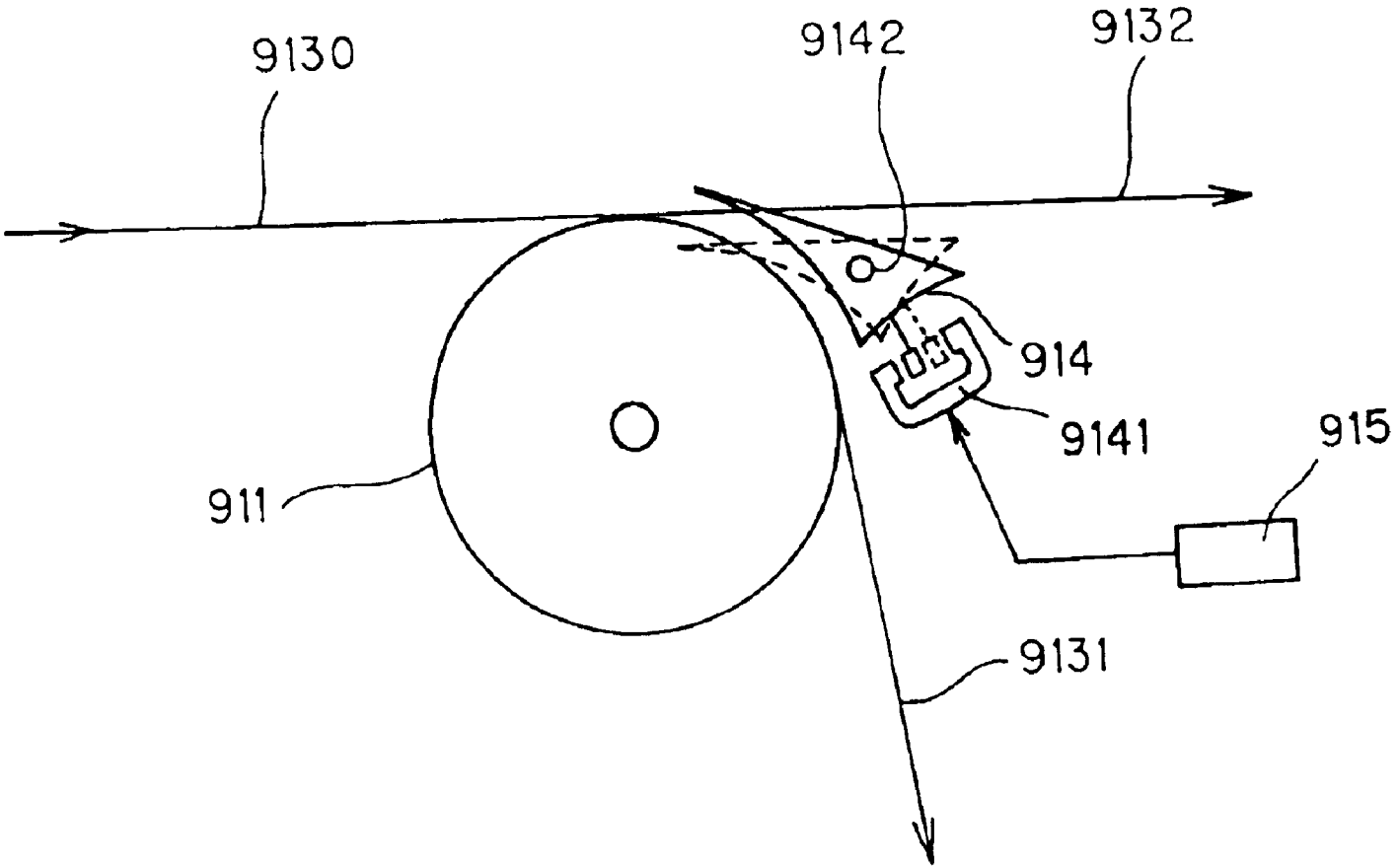
FIG. 4 is a schematic diagram showing a method for changing transfer routes by a gate.

FIG. 4 is a schematic diagram showing a method for changing transfer routes by a gate.

In this figure, one example of the junction of a transfer route is shown. A bill that has been transferred from the left side in the figure along a transfer route 9130 is transferred on a transfer route 9131 going downward in the figure along the transfer roller 911, or transferred on a transfer route 9132 that goes straight toward the right side in the figure.

The gate 914 is of a shape of a wedge, and is arranged with its end toward the junction, between the transfer route 9132 going toward the right side in the figure and the transfer route 9131 going downward in the figure. This gate 914 is rotated by a gate magnet 9141 around a rotating shaft 9142 as a rotating center, and this gate magnet 9141 is controlled by the comprehensive control portion 915 shown in FIG. 1.

When the gate 914 is controlled so that the end of its wedge shape faces upward as shown with the solid line in the figure, a bill that has been transferred from the left side in the figure is transferred downward along the gate 914. When the gate 914 is controlled so that the end of its wedge shape faces downward as shown in the dot line in the figure, a bill that has been transferred from the left side in the figure is transferred to the right side along the gate 914.

Figure 5:
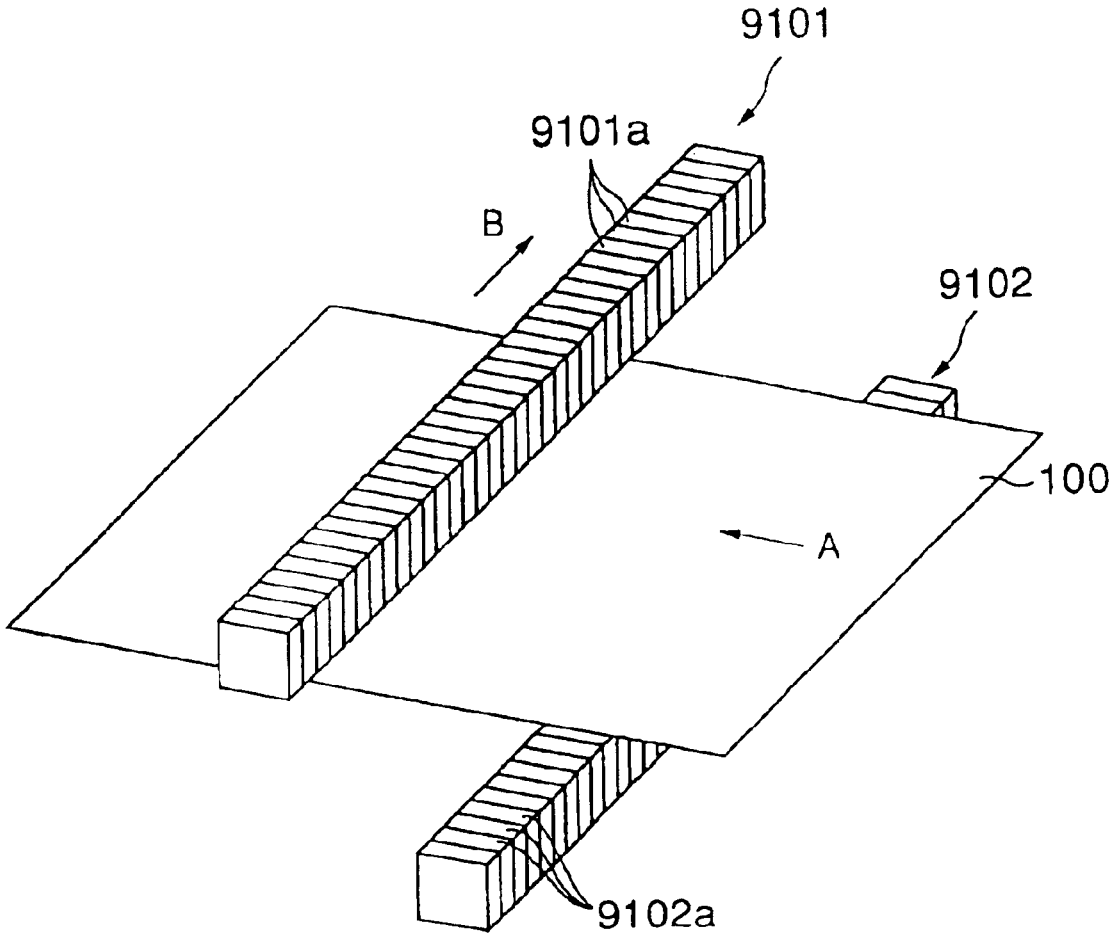
FIG. 5 is a schematic diagram showing an optical sensor arranged in a discriminating unit.

FIG. 5 is a schematic diagram showing an optical sensor arranged in a discriminating unit.

The discriminating unit is equipped with an optical sensor array 9101 wherein plural sensor devices 9101a are arranged in the width direction (arrow B direction) crossing the arrow A direction, and an optical sensor array 9102 wherein plural sensor devices 9102*a* are arranged in the arrow B direction in the same manner as this, so that these two optical sensor arrays should sandwich therebetween a bill 100 that passes in the arrow A direction.

Along these two optical sensor arrays 9101 and 9102, each light source (not illustrated herein) is arranged, and the bill 100 passing in the arrow A direction is radiated by the light source at the side of the optical sensor array 9101, and the reflected light is received by each of sensor devices 9101*a* of the optical sensor array 9101, and in the same manner, the bill 100 passing in the arrow A direction is radiated by the light source at the side of the optical sensor array 9102, and the reflected light is received by each of sensor devices 9102*a* of the optical sensor array 9102. The bill 100 passing in the arrow A direction is radiated by the light source at the side of the optical sensor array 9101, and the transmitted light thereof is received by each of sensor devices 9102*a* of the optical sensor array 9102. The receiving of the reflected light and the receiving of the transmitted light are repeated in time sharing manner at high speed while one sheet of paper passes there.

Explanations are made referring to FIG. 3 again.

The BRU 900 has four action modes to be described hereinafter (depositing mode, withdrawing mode, replenishing mode, and collecting mode) as its fundamental modes, and the comprehensive control portion 915 receives instructions of action modes from the outside, and controls each portion according to the instructions.

The depositing mode is a mode wherein bills are charged into the ATM by a user of the ATM, and in this depositing mode, bills which are charged into the charge box 906 by an ATM user are taken into the inside, discriminated and sorted, and contained into the two stackers 901 and 902 and the five thousand yen bill box 903 per denomination of bills.

The withdrawing mode is the mode wherein payment of bills from the ATM to a user is carried out, and in this withdrawing mode, bills to be paid to the ATM user are taken out from the stackers 901 and 902, and discriminated and contained into the charge box 906.

While, the replenishing mode is the mode wherein bills are replenished to the ATM by the managers of the ATM, and in this replenishing mode, bills contained in the cassette 907 are taken out from the cassette 907 and discriminated and contained into the stackers 901 and 902.

Further, collecting mode is the mode wherein bills are collected from the ATM by the managers of the ATM, and in this collecting mode, bills contained in the two stackers 901 and 902 are taken out from the stackers 901 and 902 respectively, and discriminated and contained into the cassette 907.

Figure 6:
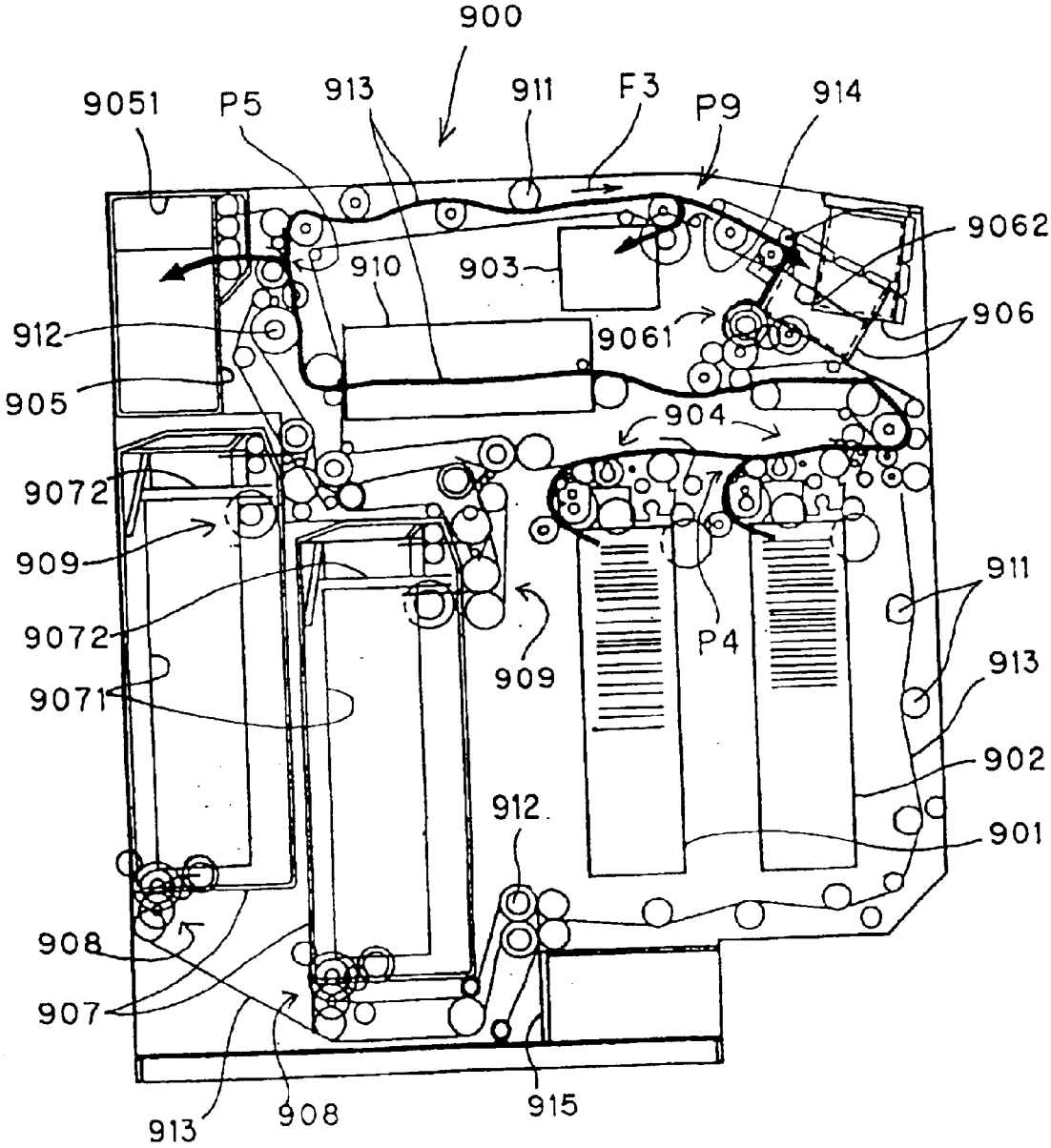
FIG. 6 is a diagram for explaining the actions of the BRU in payment money mode.
Figure 7:
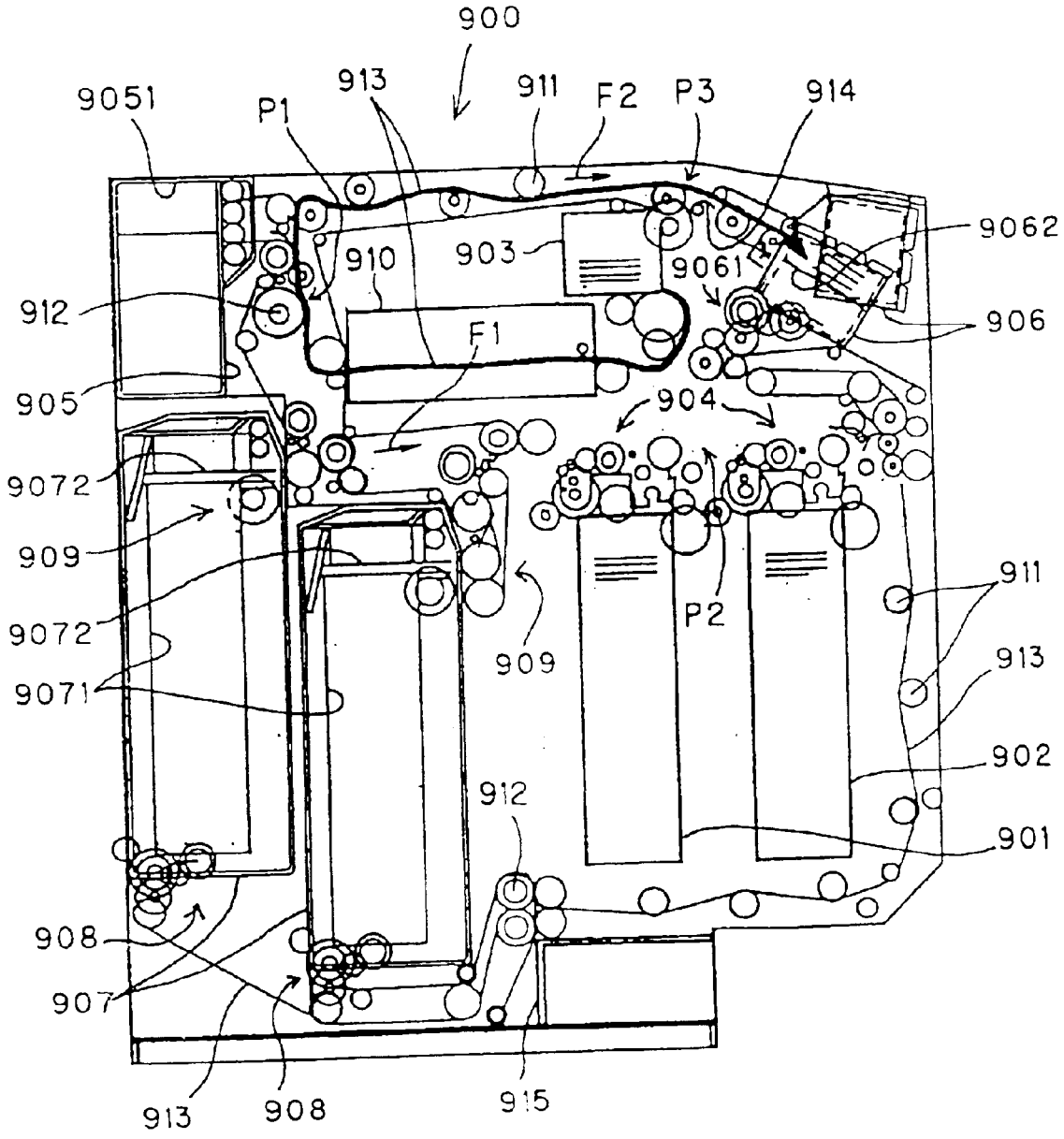
FIG. 7 is a diagram for explaining the actions of the BRU after a bill that cannot be discriminated is stored in a pool portion, in a withdrawing mode.
Figure 8:
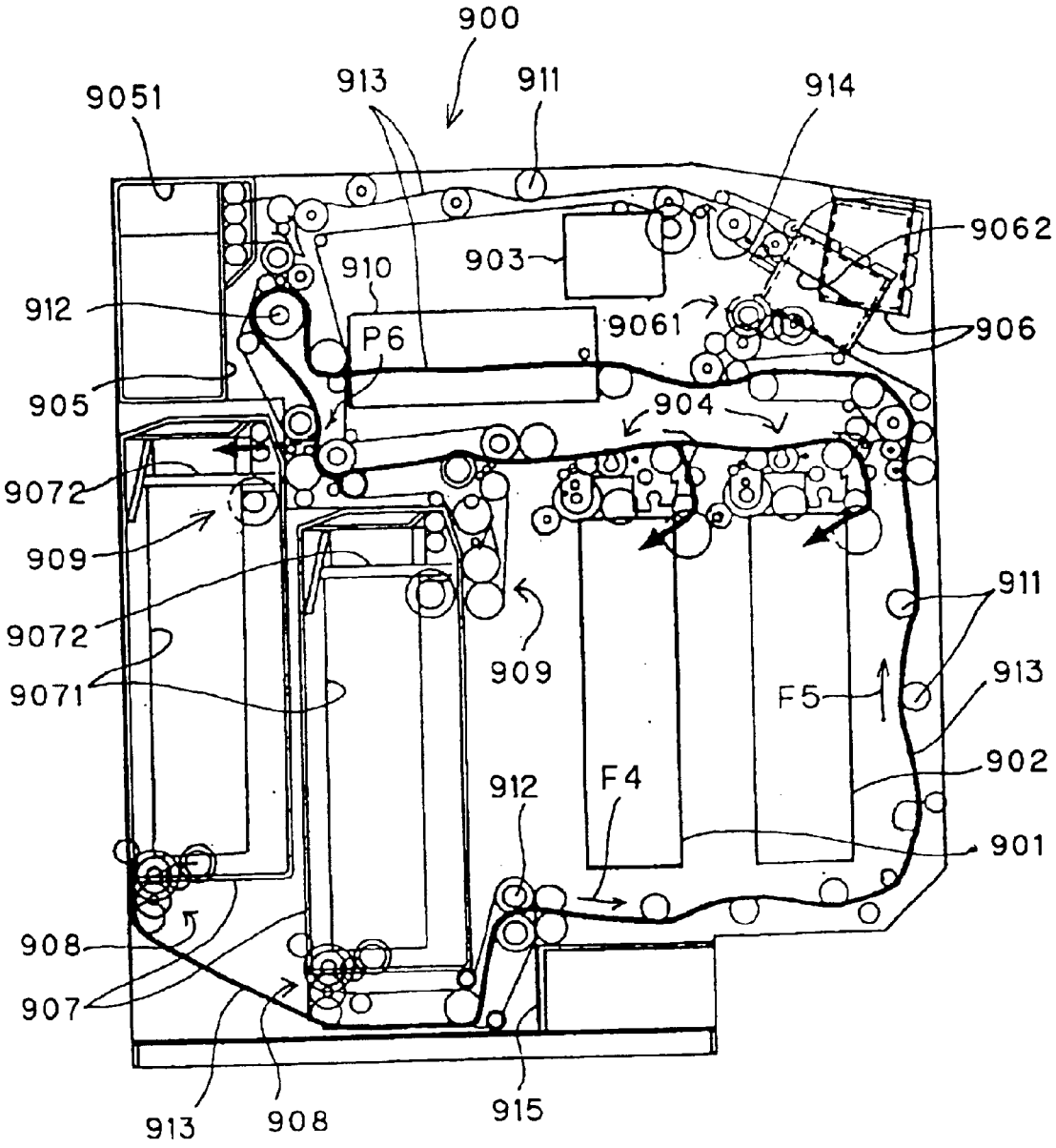
FIG. 8 is a diagram for explaining the actions of the BRU in a replenishment mode.
Figure 9:
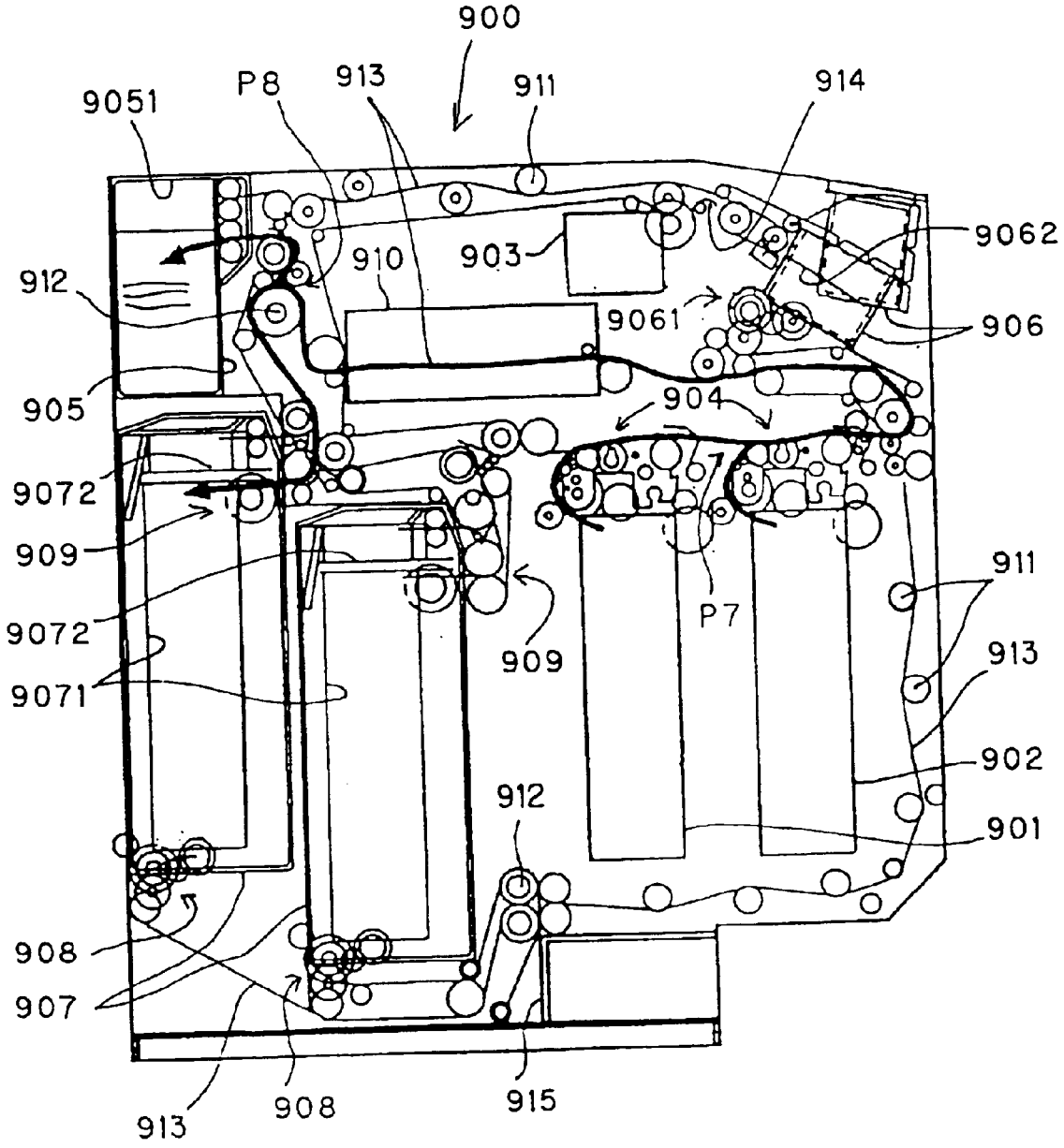
FIG. 9 is a diagram for explaining the actions of the BRU in a collection mode.

In FIG. 6 through FIG. 9, a BRU same as the BRU 900 shown in FIG. 3 is shown. The arrow mark shown in FIG. 3 represents a bill transfer route in the depositing mode, and in the same way, the arrow mark shown in FIG. 6 and FIG. 7 represents a bill transfer route in the withdrawing mode, and the arrow mark shown in FIG. 8 represents a bill transfer route in the replenishing mode, while the arrow mark shown in FIG. 9 represents a bill transfer route in the collecting mode.

Hereafter, first referring to FIG. 3, actions of the BRU 900 in the depositing mode are explained.

First, the charge box 906 is positioned at its top position, and bills are charged into the charge box 906 by an ATM user, thereafter the charge box 906 moves to its lower position. At this moment, the bills charged into the charge box 906 are positioned at the lower portion of the partition plate 9062 in the charge box 906. The bills are taken out one after another by the takeout mechanism 9061, and transferred to the left side in the figure by the transfer belt 913, and then go through the discriminating unit 910. In the discriminating unit 910, bills are discriminated while they are passing. Bills going out from the discriminating unit 910 are transferred upward, and reach the junction P1 on the transfer route. If the discriminating result by the discriminating unit 910 is that the bills are authentic one thousand yen bills or authentic ten thousand yen bills, then the transfer route going downward from the junction P1 is selected by the gate arranged at the junction P1, while, if the discriminating result is that the bills are authentic five thousand yen bills or abnormally shaped bills or the similar, the transfer route going upward from the junction P1 is selected by the gate.

When a bill is transferred downward from the junction P1, the bill is transferred to the right side in the figure along the arrow mark F1 and reaches the junction P2. If the discriminating result by the discriminating unit 910 is that the bill is a one thousand yen bill, then the transfer route going to the one thousand yen bill stacker 901 is selected by the gate arranged at the junction P2, and the bill is contained into the one thousand yen bill stacker 901 by the takeout and containing mechanism 904. While, if the discriminating result by the discriminating unit 910 is that the bill is a ten thousand yen bill, then the transfer route going to the right side in the figure from the junction P2 is selected by the gate arranged at the junction P2, and the bill is contained into the ten thousand yen bill stacker 902 by the takeout and containing mechanism 904. When a bill is transferred upward from the junction P1, the bill is transferred to the right side in the figure along the arrow mark F2 and reaches the junction P3. If the discriminating result by the discriminating unit 910 is that the bill is a five thousand yen bill, then the transfer route going to the pool portion 903 is selected by the gate arranged at the junction P3, and the bill is contained into the pool portion 903. While, if the discriminating result by the discriminating unit 910 is that the bill is an abnormally shaped bill or the similar, then the transfer route going to the right side in the figure from the junction P3 is selected by the gate arranged at the junction P3, and the abnormally shaped bill or the similar is contained into the upper side of the partition plate 9062 of the charge box 906. Thereafter, the charge box 906 moves to its top position, and the abnormally shaped bill or the similar contained in the charge box 906 is returned to an ATM user. The five thousand yen bill contained in the pool portion 903 is transferred to the five thousand yen bill room 9051 in the reject box 905 by a mechanism not illustrated herein.

Next, referring to FIG. 6, actions of the BRU 900 in the withdrawing mode are explained hereinafter.

The takeout and containing mechanism 904 is controlled by the comprehensive control portion 915, thereby a specified denomination and specified number of bills is taken out from the two stackers 901 and 902 one after another, and the bills are transferred by the transfer belt 913 via the junction P4 to the right side in the figure. After then, the bills are transferred upward and to the left side in the figure, and go through the discriminating unit 910 and then are discriminated. The bills going out from the discriminating unit 910 are transferred upward and reach the junction P5 in the transfer route. If the discriminating result of the discriminating unit 910 is that the bills are abnormally shaped bills or the similar, then by the gate arranged at the junction P5, the transfer route toward the reject box 905 is selected, and the abnormally shaped bills or the similar are contained into the reject box 905. While, if the discriminating result is that the bills are normal bills, by the gate at the junction P5, the transfer route going upward from the junction P5 is selected, and the bills are transferred upward and transferred to the right side in the figure along the arrow mark F3, and in normal cases, the transfer route going to the right side in the figure is further selected by the gate at the junction P9, and the bills are contained into the charge box 906. Thereafter, the charge box 906 moves to its top position, and the bills contained in the charge box 906 are paid to a user. Herein, though details will be described later, in a status wherein it is impossible to make a correct discrimination, the transfer route going upward from the junction P5 is selected by the gate at the junction P5, and the bill to which discrimination cannot be made is transferred to the right side in the figure along the arrow mark F3, and the transfer route going toward the pool portion 903 is selected by the gate at the junction P9, and such a bill is contained in the pool portion 903 in some cases.

FIG. 7 is a diagram for explaining the actions of the BRU 900 after a bill that cannot be discriminated is contained in a pool portion, in the withdrawing mode.

Bills contained temporarily in the pool portion 903 are sent out one after another from the pool portion 903 after the discriminating unit 910 becomes normally operative, and are discriminated while they are passing through the discriminating unit 910, and abnormally shaped bills or the similar are contained into the reject box 905, while, normal bills are transferred to the charge box 906, and contained into the charge box 906. Herein in the withdrawing status, bills used for withdrawing are bills managed and contained in this ATM, so there is a rare case where bills are judged as abnormally shaped ones or the similar and contained into the reject box 905, however in the case of abnormally shaped bill or the similar, bills for replenishing a lack of bills for withdrawing are added to the charge box 906 via the transfer route explained referring to FIG. 6.

Next, referring to FIG. 8, actions of the BRU 900 in the replenishing mode are explained hereinafter.

Herein, actions in the case where a spare cassette is not used are explained. Meanwhile, the actions in the case where the spare cassette is used are similar to those explained hereinafter.

Prior to actions of this replenishing mode, the cassette 907 containing bills is set onto this ATM.

In replenishing mode, bills contained in the cassette 907 are taken out one after another by the takeout mechanism 908, and transferred to the right side in the figure along the arrow mark F4 by the transfer belt 913, and then transferred upward along the arrow mark F5, and transferred to the left side in the figure, and go through the discriminating unit 910, whereby they are discriminated. Bills going out from the discriminating unit 910 are temporarily transferred upward, and then transferred downward and reach the junction P6 in the transfer route. If the discriminating result by the discriminating unit 910 is that bills are abnormally shaped bills or the similar, then by the gate arranged at the junction P6, the transfer route going toward the cassette 907 is selected, and abnormally shaped bills or the similar are contained into the reject room 9072 in the cassette 907. While, if the discriminating result appears that the bills are normal, then by the gate at the junction P6, the transfer route going downward from the junction P6 is selected. Thereafter, the bills are contained into stackers 901 and 902 per denomination in the same manners as in the depositing mode.

Next, referring to FIG. 9, actions of the BRU 900 in the collecting mode are explained hereinafter.

Same as in the explanations for the replenishing mode, only actions in the case where the spare cassette is not in use are explained hereafter.

Prior to the actions in the collecting mode, an empty cassette 907 is set into this ATM.

In the collecting mode, bills contained in the two stackers 901 and 902 are taken out one after another by the takeout and containing mechanism 904, and transferred by the transfer belt 913 to the right side in the figure via the junction P7, and transferred upward, then transferred to the left side in the figure, and pass through the discriminating unit 910, whereby they are discriminated. Bills going out from the discriminating unit 910 are transferred upward and reach the junction P8 in the transfer route. If the discriminating result by the discriminating unit 910 is that the bills are abnormally shaped bills or the similar, then by the gate arranged at the junction P8, the transfer route going toward the reject box 905 is selected, and abnormally shaped bills or the similar are contained into the reject box 905. While, if the discriminating result appears that the bills are normal, then by the gate at the junction P8, the transfer route going downward from the junction P8 is selected, and the bills are contained into the cassette 907 by the containing mechanism 909.

The bills contained in the cassette 907 are taken out, together with the cassette, from the machine.

Figure 10:
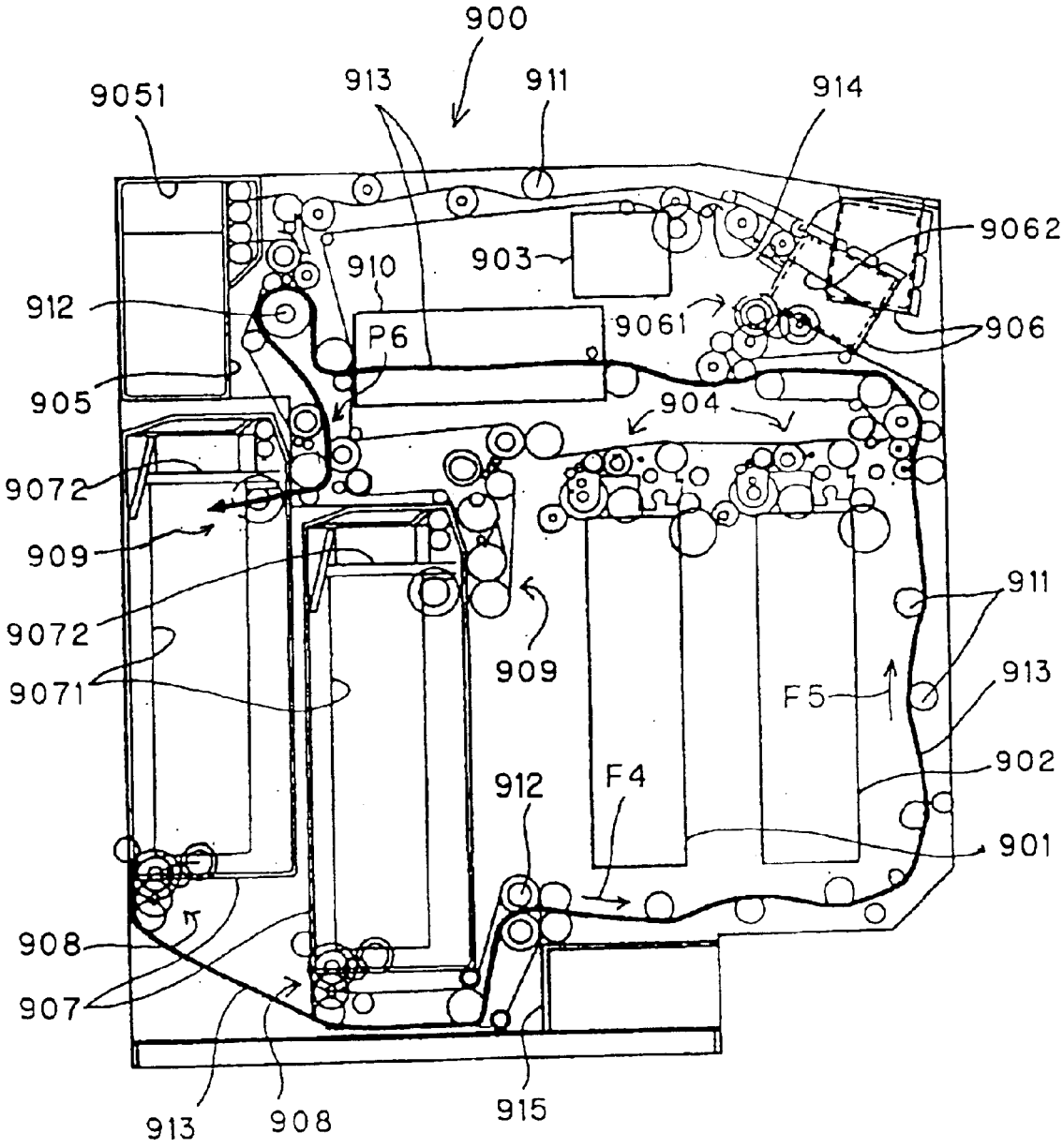
FIG. 10 is a diagram for explaining the actions of mock bill transfer.

FIG. 10 is a diagram for explaining the actions of mock bill transfer.

Besides the four action modes, this BRU 900 has a mode for transferring mock bills. The cassette 907 wherein mock bills are contained is set in advance, and, when mock bills are transferred, in the same manners as in the case for the replenishing mode (Refer to FIG. 8), mock bills are taken out one after another from the cassette 907 by the takeout mechanism 908, and transferred to the right side in the figure along the arrow mark F4 by the transfer belt 913, and then transferred upward along the arrow mark F5, and transferred to the left side in the figure, and go through the discriminating unit 910. The mock bills going through the discriminating unit 910 are transferred upward temporarily then transferred downward, and the transfer route going toward the cassette 907 is selected by the gate arranged at the junction P6, and the mock bills are contained into the reject room 9072 of the cassette 907. The purpose of this mock bill transfer will be described later.

Figure 11:
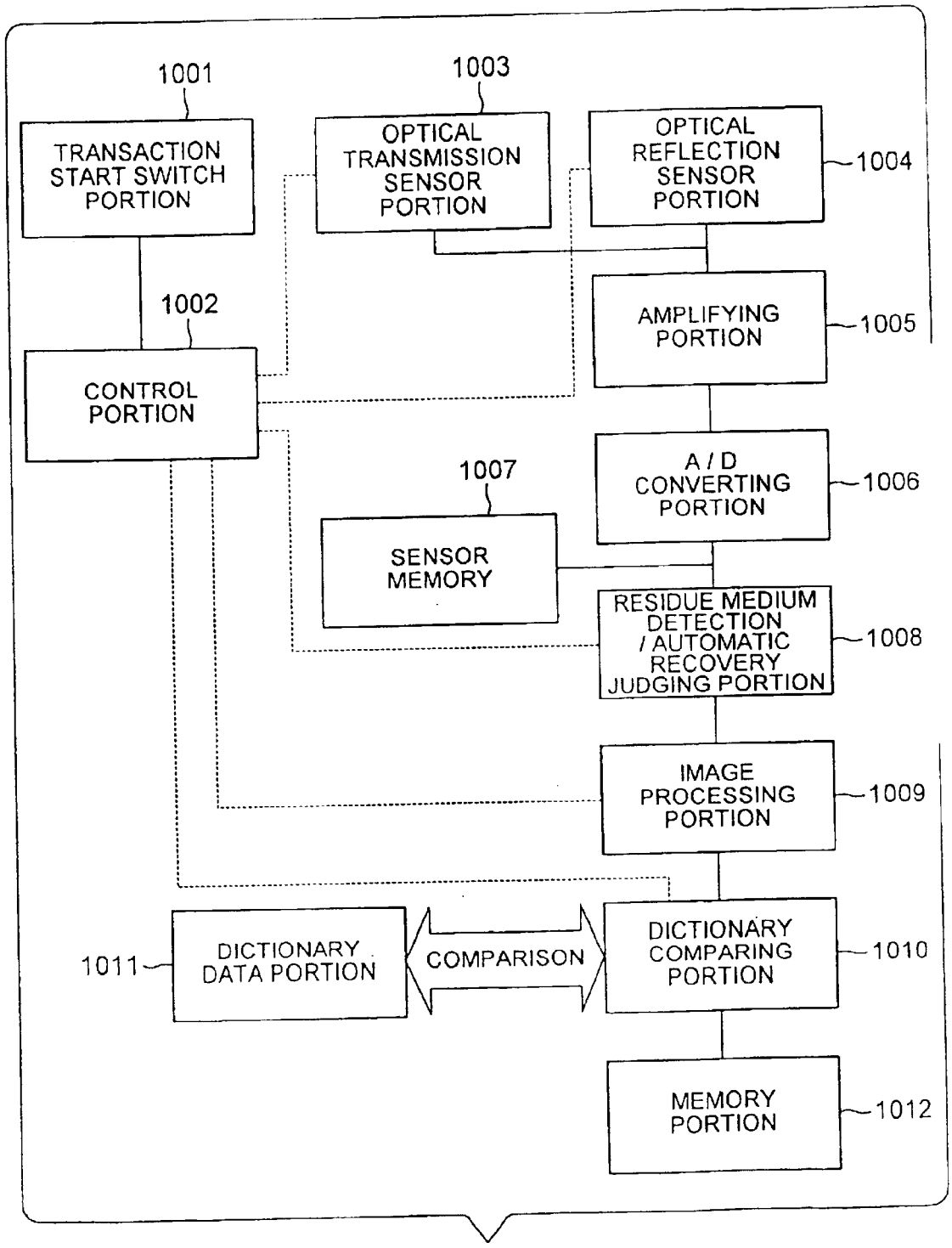
FIG. 11 is a block diagram showing a discriminating process circuit in the BRU.

FIG. 11 is a block diagram showing a discriminating process circuit in the BRU.

A transaction start switch portion 1001 has the function to recognize the operations on the touch keyboard 520 at the operation display portion 2 of the ATM 10 shown in FIG. 1 and FIG. 2 to transmit them to a control position 1002, and when a transaction operation (depositing or withdrawing) is carried out by use of the touch keyboard 520, a signal corresponding to the operation is transmitted from the transaction start switch portion 1001 to the control portion 1002. This control portion 1002 is a circuit section that controls the whole discriminating processing circuit, and when this control portion 1002 receives the signal showing the start of transaction from the transaction start switch portion 1001, the control portion 1002 communicates with the comprehensive control portion 915 (Refer to, for example, FIG. 3.) that controls the transfer of bills by the BRU 900, and controls each circuit portion to carry out the following discriminating process in synchronization with bill transfer.

An optical transmission sensor portion 1003 and an optical reflection sensor portion 1004 are circuit portions that respectively sense a transmitted light and a reflected light of bills in the discriminating unit explained referring to FIG. 5, and first, prior to the start of one transaction, even though there is no bill yet, outputs of the optical sensor arrays 9101 and 9102 shown in FIG. 5 are sensed, thereafter, in synchronization with the timing at which bills go through the discriminating unit, the transmitted light and the reflected light of the bills are sensed. Signals obtained by sensing at the optical transmission sensor portion 1003 and the optical refection sensor portion 1004 are amplified by an amplifying portion 1005, and converted into digital signals by an A/D converting portion 1006, and are stored in a sensor memory 1007 temporarily.

A residue medium detection/automatic recovery judging portion 1008 judges, on the basis of the signals sensed prior to the start of one transaction, whether all the sensor devices 9101*a* and 9102*a* arranged in the optical sensor arrays 9101 and 9102 shown in FIG. 5 have output normal signals or not, and when the output of a small number of sensor devices, for example one or two sensor devices among the sensor devices 9101*a* and 9102*a* appears to be a signal as if there exist bills, then the residue medium detection/automatic recovery judging portion 1008 judges that there is paper powder or a small paper chip, while, when the output of a number of sensor devices exceeding that number appears to be a signal as if there exist bills, then the residue medium detection/automatic recovery judging portion 1008 judges that there is a significantly large paper chip or the similar.

As is described later, when it is judged that there is paper powder or a small paper chip (hereinafter collectively referred to as paper powder), since there is no trouble about bill transfer itself, bill transfer is started, while the residue medium detection/automatic recovery judging portion 1008 monitors whether paper powder is still left in the portions of the optical sensor arrays 9101*a* and 9102*a* even after the start of bill transfer or paper powder has been removed, and when the paper powder has been removed, it informs the control portion 1002 that the discriminating unit has recovered to normal status.

After the discriminating unit has recovered to normal status, or when paper powder or the similar is not found as a result of sensing prior to the start of transaction and all the outputs of the sensor devices 9101*a* and 9102*a* configuring the optical sensor arrays 9101 and 9102 are normal, then the following process is further carried out.

Namely, in the image processing portion 1009, images of bills stored temporarily in the sensor memory 1007 are read out, and image processing including correction of inclined images owing to bills being transferred inclined and the like is carried out.

In a dictionary data portion 1011, image data representing typical images of a one thousand yen bill, five thousand yen bill and ten thousand yen bill is stored, and in a dictionary comparing portion 1010, images after processing at the image processing portion 1009 are compared with typical images stored in the dictionary data portion 1011, and discrimination whether bills that have passed through the discriminating unit this time are authentic or not, and whether bills are one thousand yen bills, five thousand yen bills or ten thousand yen bills is carried out. The discrimination results are recorded in a memory portion 1012, and also transmitted via the control portion 1002 to the comprehensive control portion 915 of the BRU 900 (Refer to for example FIG. 3.). The comprehensive control portion 915 controls gates at respective portions (Refer to FIG. 4.) according to the discrimination result, and the transfer route after passing through the discriminating unit 910, of bills just discriminated, is controlled.

Figure 12:
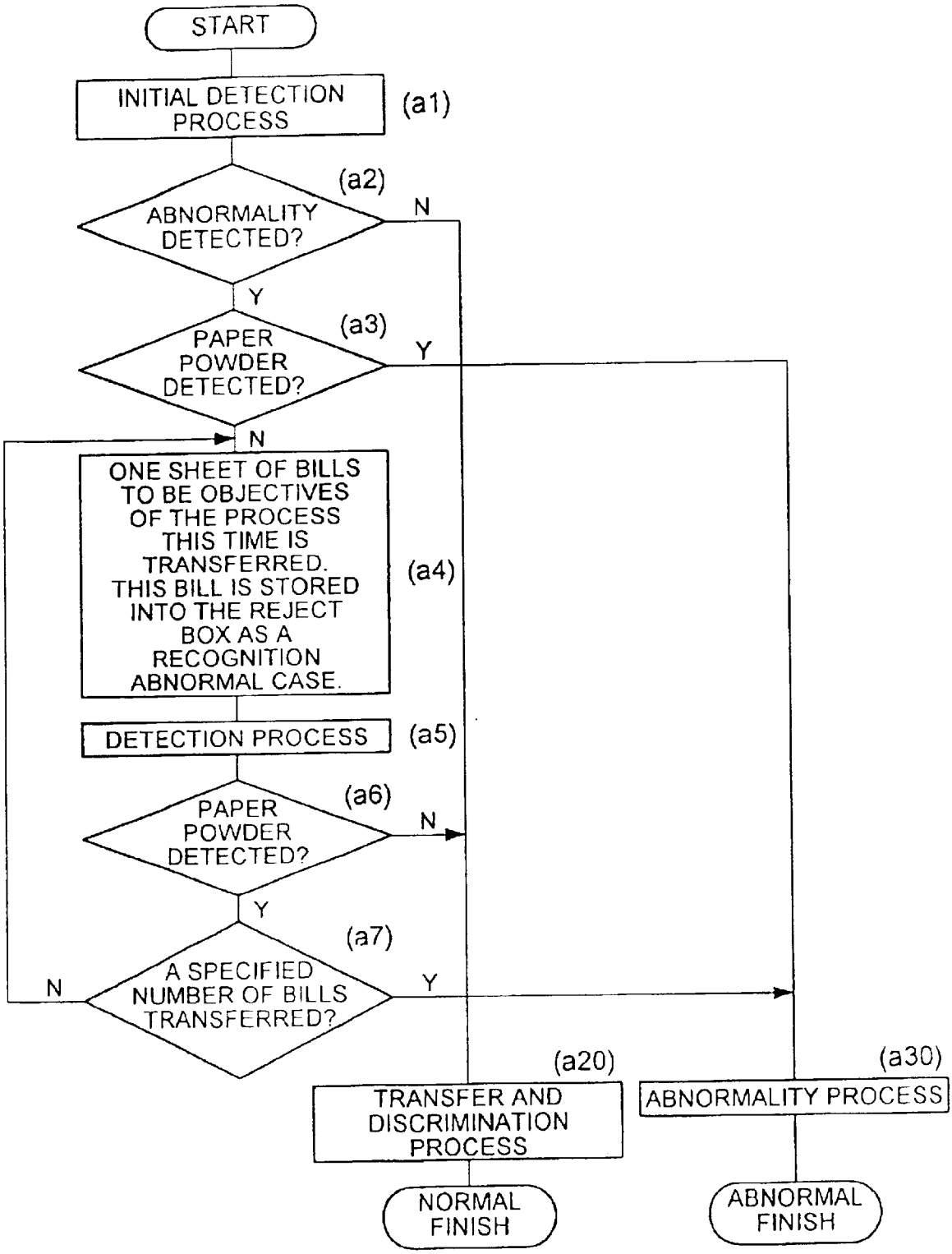
FIG. 12 is a flow chart showing a first example of residue medium detection/automatic recovery judging process.

FIG. 12 is a flow chart showing a first example of residue medium detection/automatic recovery judging process.

First, at the start of one transaction (withdrawing in this case), detection process is carried out on whether the output of each of sensor devices 9101*a* and 9102*a* configuring the optical sensor arrays 9101 and 9102 (Refer to FIG. 5.) of the discriminating unit is a signal representing that there exists no bill or the similar (this is regarded as normal signal) (step a1).

In step a2, referring to the detection process result made in step a1, it is judged whether a normal signal has been detected on all the sensor devices or an abnormal signal representing the presence of a bill or paper powder or the similar has been detected.

If it is judged that a normal signal has been detected on all the sensor devices, then the process goes to step a20, wherein the bill transfer and discrimination process mentioned above is carried out.

On the other hand, if an abnormal signal is detected in step a2, the process goes to step a3, wherein it is judged, from the number of sensor devices showing abnormal output, whether the abnormality comes from paper powder (or small paper chip) or larger paper chip or the similar. If it is judged as abnormality owing to the large paper chip or the similar, then the process goes to step a30, and the process of the transaction (herein withdrawing process) is not carried out and the BRU 900 is suspended, and abnormality processing like that a message such as "This machine is not available now." is displayed to users is carried out.

On the other hand, in step a3, if it is judged that abnormality comes from paper powder or the similar that does not cause any transfer defect even if bills are transferred, then the process goes to step a4, and one sheet of bills to be objectives of the process this time is transferred to go through the discriminating unit 910, and stored into the reject box 905 (Refer to FIG. 6.). After this bill passes through the discriminating unit, in the discrimination unit, detection process is carried out on the outputs of the optical sensor arrays 9011 and 9012, and it is judged whether any paper powder is still seen or normal status has been recovered.

When the normal status has been recovered, then the process goes to step a20, and then transfer and discriminating processes are carried out on bills to be transferred thereafter in regular manners.

In step a6, if it is judged that paper powder is found even after bills are transferred this time, then the process goes to step a7, wherein it is judged whether a specified number of bills (for example 3 sheets) has been transferred or not, and when the specified number is not attained yet, then the process goes back to step a4, and next one bill is transferred. Herein the specified number is defined as an expected number of bills that may remove paper powder, if the paper powder can be removed by passing of bills, that can be removed by passing of the number of bills equal to or fewer than this number, and may be set optionally.

When the above is repeated and the specified number of bills is transferred but paper powder is not removed, then the process goes to step a30, and abnormality processing is carried out.

In this manner, even when an error is found with sensors, abnormality processing to stop machine at once and suspend transaction is not carried out, and when there is no problem with bill transfer itself, bills are transferred and it is detected whether the abnormality has been removed or not, thereby the number of stop failures is reduced significantly.

Figure 13:
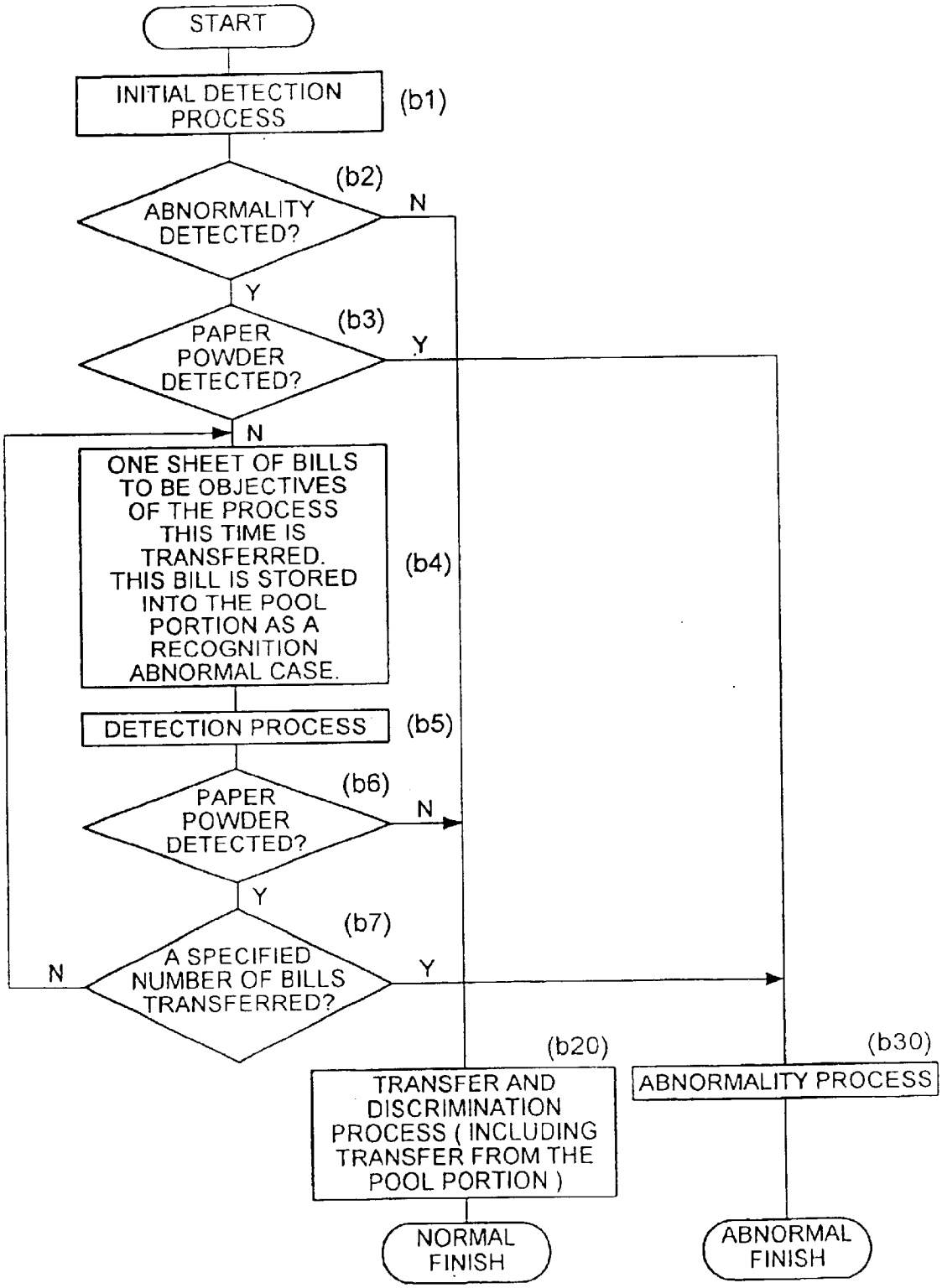
FIG. 13 is a flow chart showing a second example of residue medium detection/automatic recovery judging process.

FIG. 13 is a flow chart showing a second example of residue medium detection/automatic recovery judging process. In this second example, the withdrawing process is used for explanation.

The processes of each step excluding step b4 and step b20 in this second example are identical to those of each corresponding step in the first example shown in FIG. 12, so redundant explanations are omitted herein, and explanations are made on step b4 and step b20.

In step a4 in the first example shown in FIG. 12, the bill transfer destination is the reject box 905, while, in step b20 in the second example in this FIG. 13, bills are transferred to and contained in the pool portion 903.

In the transfer and discrimination process of step a20 in the first example shown in FIG. 12, bills are all taken out from the stackers 901 and 902, and bills contained in the reject box 905 are not recycled without process by an operator, while, in step b20 in the second example shown in FIG. 13, bills contained in the pool portion 903 temporarily are also used for the withdrawing process via the transfer route explained referring to FIG. 7.

In this manner, bills on which discrimination could not be made owing to the presence of paper powder are contained once in the pool portion 903 and used for withdrawing process and the like after the paper powder is removed, thereby the number of cases that bother operators can be reduced.

Figure 14:
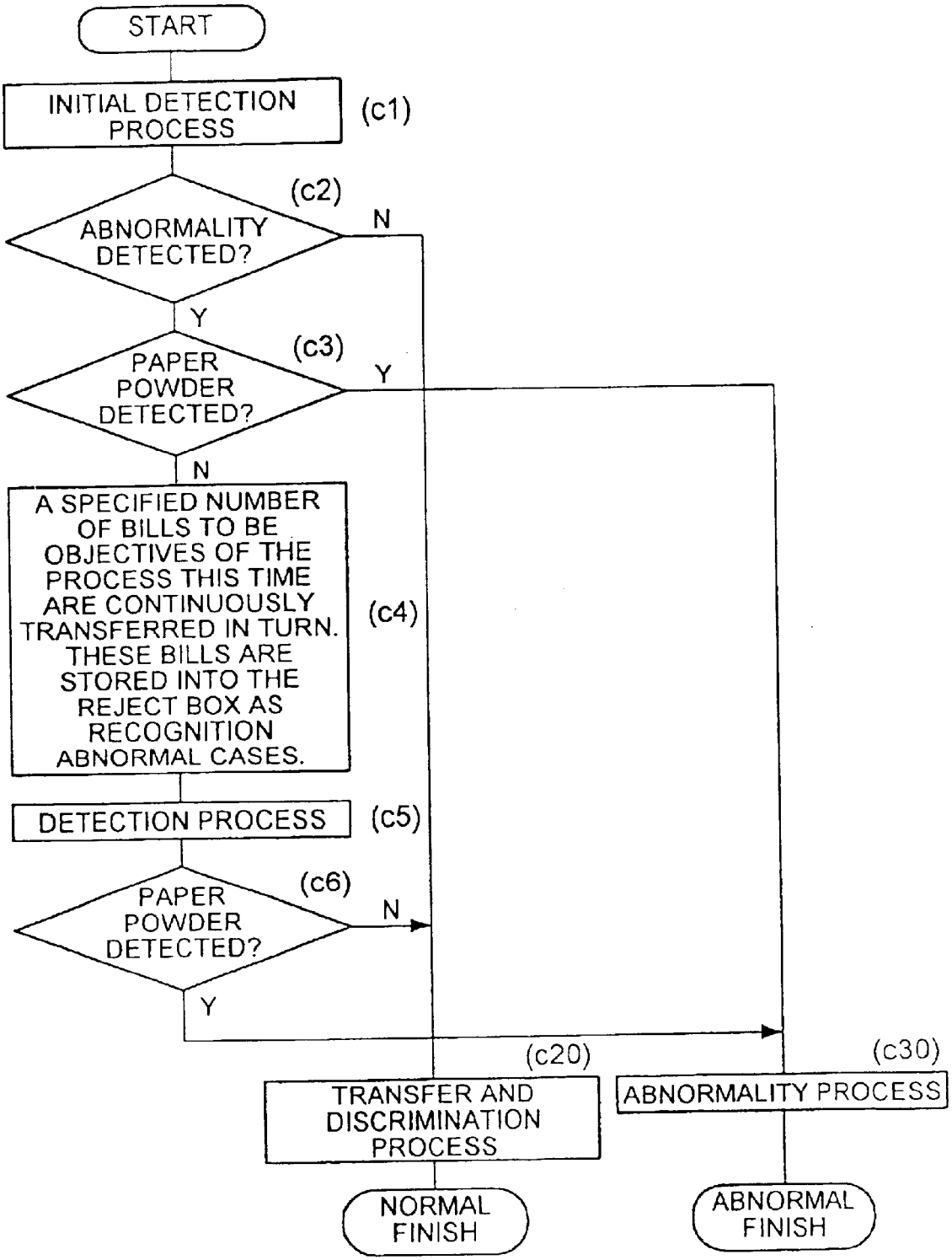
FIG. 14 is a flow chart showing a third example of residue medium detection/automatic recovery judging process.

FIG. 14 is a flow chart showing a third example of residue medium detection/automatic recovery judging process. In this third example, the withdrawing process is used for explanation.

Steps c1 to c3 in this third example are identical to steps a1 to a3 shown in FIG. 12, therefore, explanations thereof are omitted herein.

In step c4, a specified number (for example 3 sheets) of bills is continuously transferred in turn, and after going through the discriminating box, the bills are stored into the reject box. The detection process of step c5 is carried out after the specified number of bills is transferred.

Thereby, even when paper powder is removed by transfer of the first sheet of bill, a specified number (for example 3 sheets) of bills is stored in the reject box, however, it is possible to make processing speedy in comparison with the case wherein detection process is carried out every time one sheet of bill is transferred.

Steps c5, c6, c20 and c30 in the third example shown in this FIG. 14 correspond respectively to step a5, a6, a20 and a30 in the first example shown in FIG. 12, so their explanations are omitted herein. In the third example shown in this FIG. 14, the process corresponding to step a7 in the first example shown in FIG. 12 is unnecessary.

Figure 15:
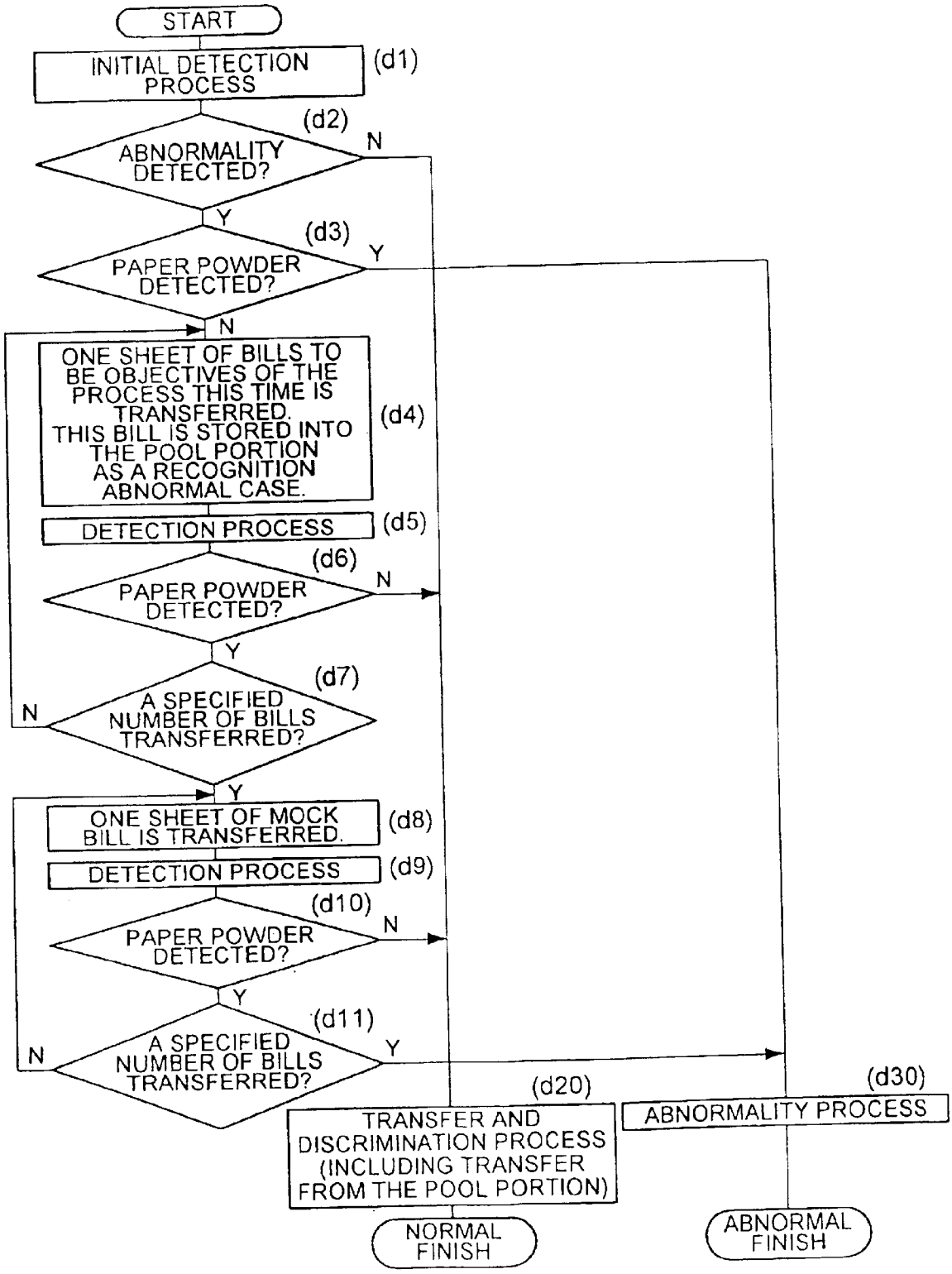
FIG. 15 is a flow chart showing a fourth example of residue medium detection/automatic recovery judging process.

FIG. 15 is a flow chart showing a fourth example of residue medium detection/automatic recovery judging process. In this fourth example too, the withdrawing process is used for explanation.

Steps d1 to d7 are identical respectively to steps b1 to b7 in the second example shown in FIG. 13, and bills transferred in step d4 are stored in the pool portion. However, when it is judged at step d7 that a specified number of bills has been transferred, then the process does not go to the abnormality process in step d30, but goes to the transfer process of mock bills to be explained hereafter.

In step d8, one sheet of mock bill is transferred along the transfer route explained referring to FIG. 10, and the process goes to step d9 wherein the sensor output detection process is carried out, and then to step d10 wherein the detection process is carried out on whether abnormality of sensor output (the detection of paper powder) has been solved or not. When paper powder detection has been cleared in step d10, the process goes to step d20, wherein normal transfer and discrimination process is carried out. The transfer and discrimination process in this step d20, as same as in step b20 in FIG. 13, includes transfer process of bills from the pool portion if bills are contained the pool portion.

In step d11, it is judged whether a specified number of mock bills has been transferred or not, and if the specified number is not attained yet, the process goes back to step d8, and another sheet of mock bill is transferred. When it is judged that a specified number of mock bills has been transferred in step d11, then the process shifts to the abnormality process of step d30. The abnormality process in this step d30 is identical to each abnormality process in steps a30, b30 and c30 in FIG. 12 through FIG. 14.

Meanwhile, the specified number of mock bills in step d11 does not need to be identical to the specified number of bills in step d7, and respective specified numbers may be set appropriately.

The reason why mock bills are transferred in steps d8 to d11 when paper powder cannot be removed in steps d1 to d7, is that normally, the optical sensor arrays 9101 and 9102 arranged in the discriminating unit (Refer to FIG. 5) are longer than the width in the direction at right angle (arrow mark B direction shown in FIG. 5) to bill passing direction (arrow mark A direction shown in FIG. 5), and when paper powder is attached onto the sensor device outside of the width of bills, it is impossible to remove the paper powder even if bills are made to pass.

Therefore herein, mock bills whose width in the arrow mark B direction shown in FIG. 5 is wider than the width of a bill are prepared, and when the paper powder is not removed in steps d4 to d7 in FIG. 15, in order to solve output error of sensor devices arranged at the end of an optical sensor array, mock bills are transferred in steps d8 to d11.

Figure 16:
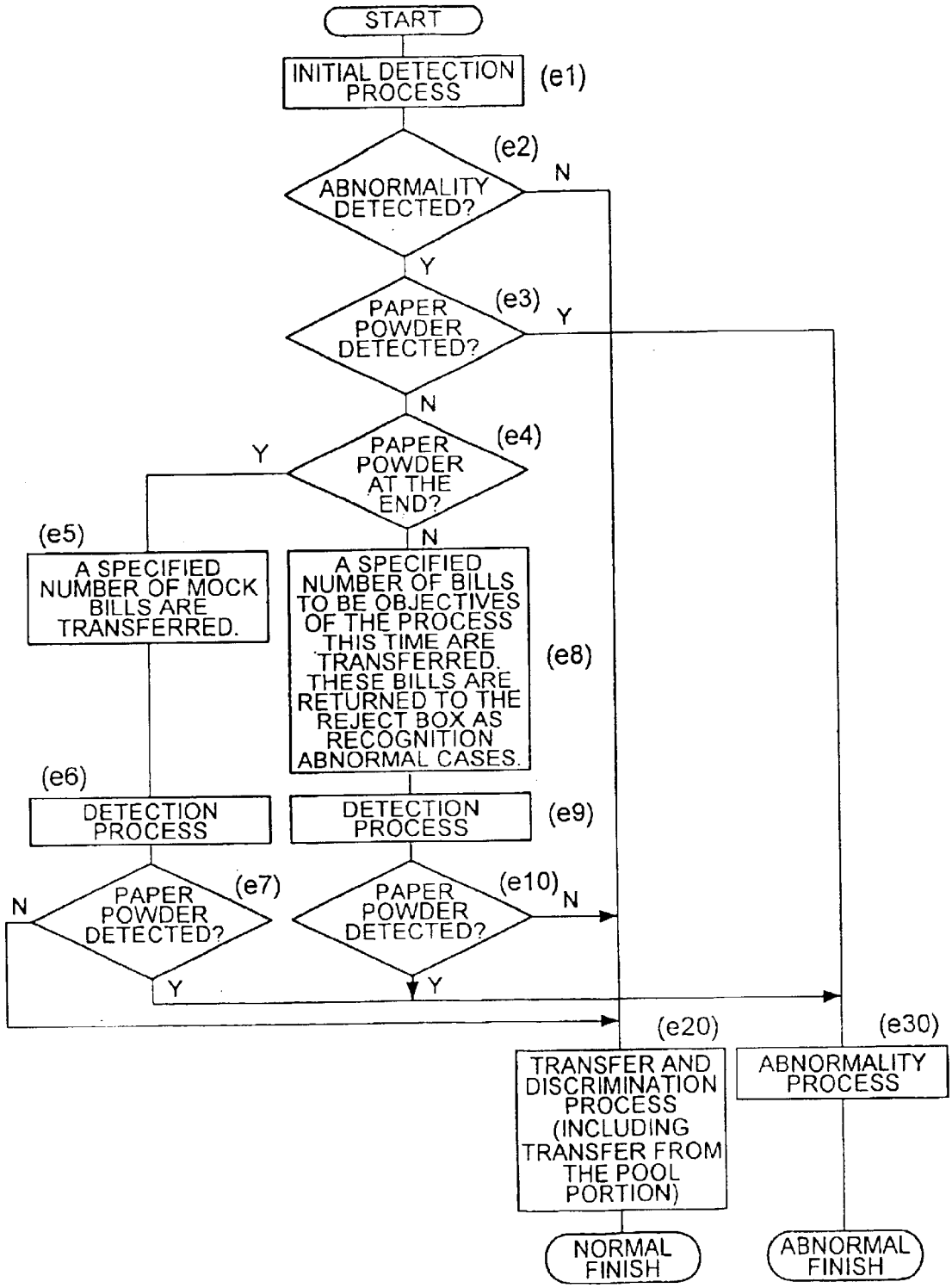
FIG. 16 is a flow chart showing a fifth example of residue medium detection/automatic recovery judging process.

FIG. 16 is a flow chart showing a fifth example of residue medium detection/automatic recovery judging process. In this fifth example too, the withdrawing process is used for explanation.

In step e1, at the start of transaction (withdrawing process) this time, the sensor output detection process is carried out, and in step b2, it is judged whether there is abnormality with sensor output or not. If without error, the process goes to step e20, wherein normal transfer and discrimination process is carried out.

When any error is found with sensor output, the process goes to step e3, and it is judged whether paper powder has been found or not. The process in this step e3 is identical to step a3 in the first example shown in FIG. 12, therefore, detailed explanations thereof are omitted herein.

In the case wherein abnormality exceeding the range of paper powder has been detected, the process goes to step e30, and the same abnormality process as step a30 in the first example shown in FIG. 12 is carried out.

In the case wherein abnormality that may be regarded as paper powder has been detected, the process goes to step e4, and it is judged whether the paper powder exists at the end of an optical sensor array or at the center portion thereof. Herein the center portion means a portion of an optical sensor array corresponding to the bill passing area, while the end means a portion out of the center.

Herein, from output of sensor devices of an optical sensor array, if it is judged that paper powder exists at the end (when it is judged that the plural number of paper powder particles exist, one of the paper powder particle of the bill exists at the end), then the process goes to step e5, and a specified number of mock bills is transferred, thereafter in step e6, the paper powder detection process is carried out, and when it is judged that the paper powder has been removed in step e7, the process goes to step e20, wherein the transfer and discrimination process is carried out. On the other hand, when it is judged that paper powder has not been removed in step e7, the process goes to step e30, wherein abnormality process is carried out.

In step e4, if it is judged that the position of detected paper powder is only at the center of an optical sensor array, the process goes to step e8, and a specified number (for example 3 sheets) of bills is transferred. The transferred specified number of bills is stored into the pool portion. Then, in step e9, paper powder detection process is carried out, and in step e10, it is judged whether paper powder has been removed or not, and when paper powder has been removed, the process goes to step e20, wherein transfer and discrimination process including transfer of bills from the pool portion is carried out. If it is judged that paper powder is still left in step e10, the process goes to step e30, wherein abnormality process is carried out.

The transfer and discrimination process in step e20 and the abnormality process in step e30 are same respectively as the transfer and discrimination process in step b20 in the second example and the abnormality process in step b30 shown in FIG. 13.

When paper powder is detected, if mock bills are transferred indiscriminately, the number of mock bills to be used increases, on the other hand, if bills are transferred indiscriminately when paper powder is detected, bills are transferred even in the case of paper powder that cannot be removed, which requires unnecessary time, therefore, in this fifth example, the judgment at step e4 is carried out, and according to the judgment result, mock bills or bills are transferred.

Figure 17:
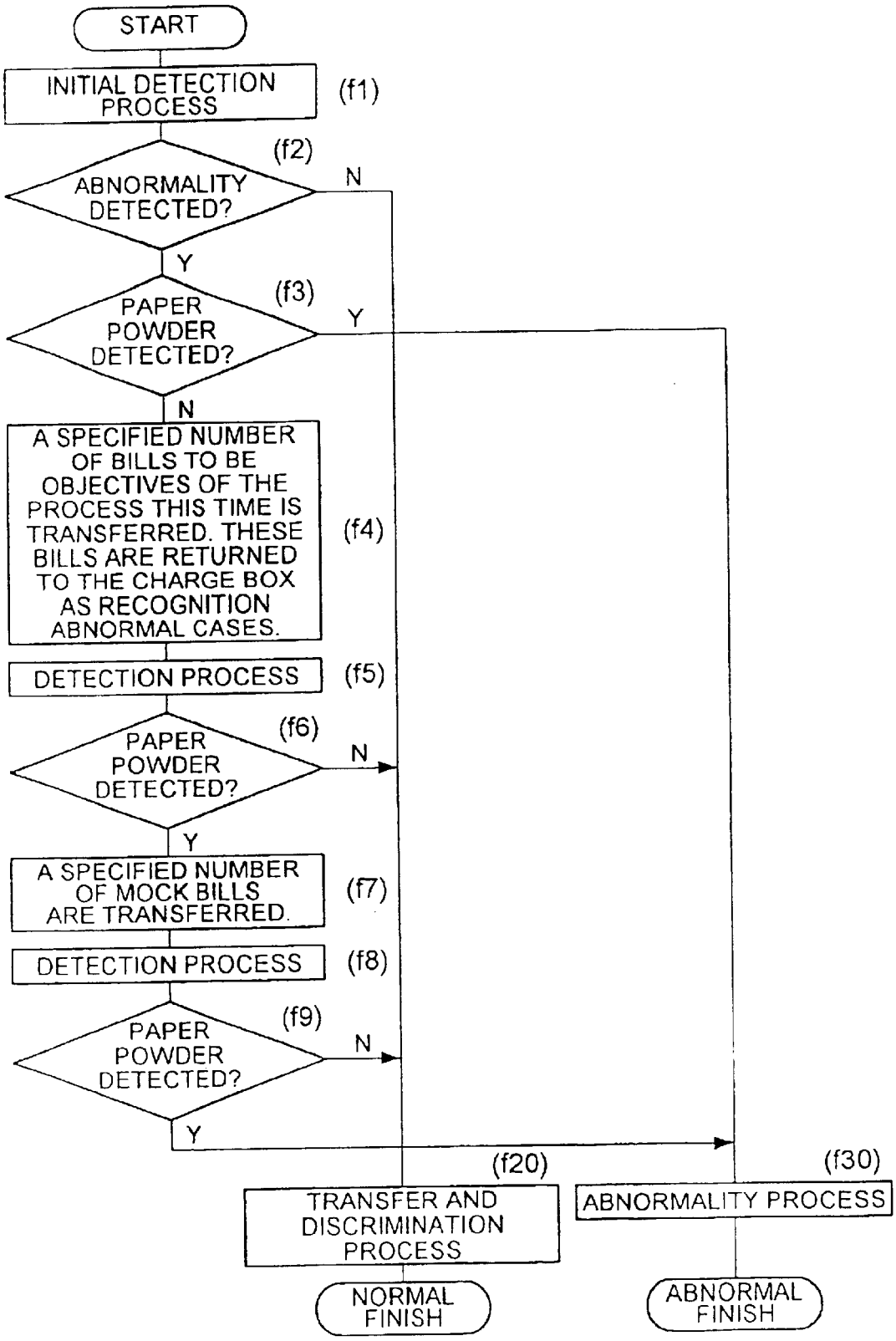
FIG. 17 is a flow chart showing a sixth example of residue medium detection/automatic recovery judging process.

FIG. 17 is a flow chart showing a sixth example of residue medium detection/automatic recovery judging process. This sixth example is one for the depositing process.

Except the difference between withdrawing process and depositing process, steps f1 to f6 are identical to steps c1 to c6 in the third example shown in FIG. 14. However, in step f11, bills are returned to the charge box. When the number of bills charged into the charge box in the depositing process this time is fewer than the specified number, then the number of charged bills is regarded as the specified number.

When it is judged in step f6 that paper powder has not been removed yet, the process goes to step f7, wherein a specified number of mock bills is transferred, after then detecting process is carried out once again (step f8), and it is further judged whether paper powder has been detected or not (step f9), and when paper powder has been removed, normal transfer and discrimination process is carried out on bills thereafter (step f20), and if it is judged that paper powder is still left even at step f9, abnormality process such as suspension of transaction by the machine and the like is carried out (step f30).

Figure 18:
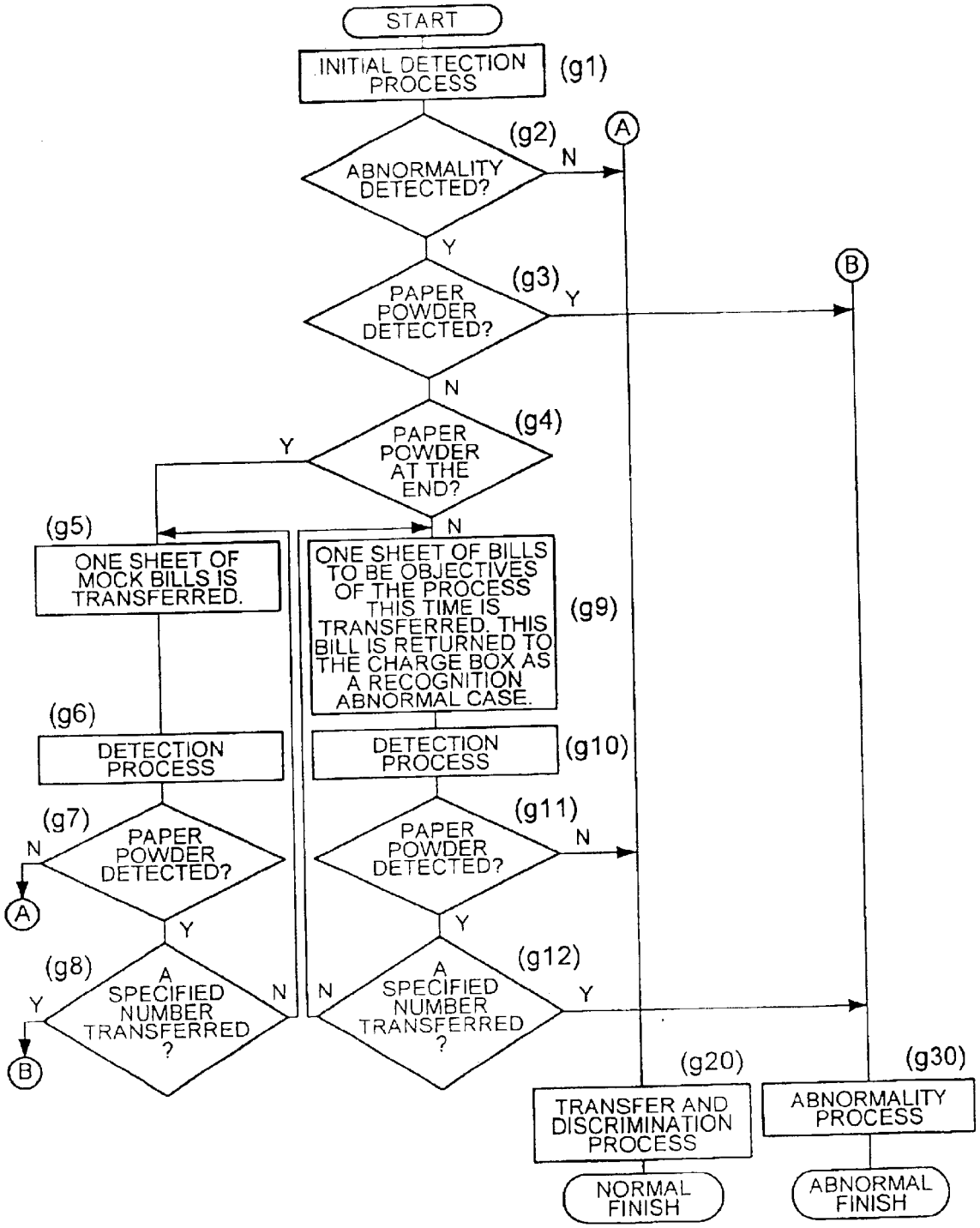
FIG. 18 is a flow chart showing a seventh example of residue medium detection/automatic recovery judging process.

FIG. 18 is a flow chart showing a seventh example of residue medium detection/automatic recovery judging process. In this seventh example too, the depositing process is used for explanation.

Steps g1 to g4, except the difference between the withdrawing process and depositing process, are identical to steps e1 to e4 in the fifth example shown in FIG. 16, therefore, their detailed explanations are omitted herein.

In step g4, if it is judged that paper powder exists at the end of an optical sensor array, then the process goes to step g5, and one sheet of mock bill is transferred, and after this one sheet of bill is transferred, paper powder detection process is carried out (step g6), and when paper powder has been removed, the process goes to the bill transfer and discrimination process at step g20, while, when paper powder is still detected, it is judged whether a specified number of mock bills has been transferred or not at step g8, and when the specified number is not attained yet, then the process goes back to step g5, and the next one sheet of mock bill is transferred. When paper powder is detected even after the specified number of mock bills is transferred, then the process shifts to abnormality process at step g30.

On the other hand, when paper powder is detected only at the center portion of an optical sensor array at step g4, the process goes to step g9, and one sheet of bill is taken out from the charge box, and goes through the discriminating unit and then returns to the charge box once again. In step g10, after the one sheet of bill goes through, the paper powder detection is carried out, and in step g11, it is judged whether paper powder has been detected or not. If the paper powder has been removed, the process on the bills thereafter goes to the transfer and discrimination process at step g20. While, if the paper powder is still to be detected, the process goes to step g12, and it is judged whether a specified number of bills (when the number of charged bills is fewer than the specified number, then the number of charged bills is regarded as the specified number) has been transferred or not, and when the specified number is not attained yet, the process goes back to step g9, and next one sheet of bill is transferred. When paper powder is detected even after the specified number of bills is transferred, the process goes to the abnormality process at step g30. The transfer and discrimination process at step g20 and the abnormality process at step g30 are identical respectively to the transfer and discrimination process at step f20 and the abnormality process at step f30 in the sixth example shown in FIG. 17.

Meanwhile, herein, various examples of the residue medium detection/automatic recovery judgment process have been shown on the withdrawing process and the depositing process, however, the residue medium detection/automatic recovery judgment process is not limited only to the withdrawing mode and the depositing mode, but may also be applied to the replenishing mode and the collecting mode mentioned previously.

What is claimed is:

1. A paper processing device which has a discriminating portion sensing papers passing by a specified sensor, and by carrying out a discriminating process according to a result of the sensing, applying one of plurally classified discriminating results to the sensed papers, and wherein, at least one paper that is an objective of a paper processing process is transferred one by one along a transfer route that passes through the discriminating portion, and transfer routes of each paper after passing through the discriminating portion is changed according to discriminating results at the discriminating portion, the paper processing device comprising:

a sensor output abnormality detecting portion that carries out a detecting process to detect that an output of the sensor is in a specified abnormal status according to the output of the sensor before a start of the paper processing process, and when the specified abnormal status is detected in the detecting process conducted before the start of the one process, further carries out a detecting process to detect the output of the sensor also after the start of the paper processing process; and a transfer control portion that starts the paper processing process even when either of the specified abnormal status or normal status is detected in an initial detecting process conducted before the start of the paper processing process by the sensor output abnormality detecting portion, and in the case where the specified abnormal status is detected in the initial detecting process, transfers at least one paper that passes through the discriminating portion after the start of the paper processing process until a normal status is detected in the detecting process of the sensor output carried out after the start of the paper processing process, along a transfer route corresponding to the specified abnormal status after the at least one paper passes through the discriminating portion, wherein the sensor is cleaned by transfer of paper, and sensor cleaning and the paper processing process are accomplished in parallel.

2. The paper processing device according to claim 1, wherein:

one of the discriminating results is that a paper is abnormal; and the transfer control portion transfers, in the case where the specified abnormal status is detected in the initial detecting process conducted before the start of the paper processing process by the sensor output abnormality detecting portion, at least one paper that passes through the discriminating portion after the start of the paper processing process and cleans the sensor, until the normal status is detected in the detecting process carried out after the start of the paper processing process, along the same transfer route as the case wherein the discriminating result that a paper is abnormal is obtained at the discriminating portion.

3. The paper processing device according to claim 1, further comprising:

a pool portion to store a paper that has been transferred along the transfer route corresponding to the specified abnormal status, wherein the transfer control portion again transfers paper stored in the pool portion, after the sensor output abnormality detecting portion detects normal status, along the transfer route to pass through the discriminating portion.

4. The paper processing device according to claim 1, wherein:

the sensor output abnormality detecting portion carries out the detecting process of the sensor output before the start of the paper processing process, and when the specified abnormal status is detected in the detecting process carried out before the start of the paper processing process, carries out the detecting process when each paper that is the objective of the paper processing process passes through the discriminating portion, after the start of the paper processing process, and carries out the detecting process until one of a number of the papers that passed through the discriminating portion reaches a predetermined number, and the normal status is detected by the sensor output abnormality detecting portion.

5. The paper processing device according to claim 1, wherein:

the sensor output abnormality detecting portion carries out the detecting process of the sensor output before the start of the paper processing process, and when the specified abnormal status is detected in the detecting process carried out before the start of the paper processing process, the transfer control portion starts the paper processing process, and after a predetermined number of papers that are objectives of the paper processing process have passed through the discriminating portion, and the sensor output abnormality detecting portion carries out a detecting process.

6. The paper processing device according to claim 1, further comprising:

a pool of mock papers different from the at least one paper that is the objective of the paper processing process, that are transferred along a transfer route passing through the discriminating portion, wherein the transfer control portion starts the paper processing process after the specified abnormal status is detected in the detecting process carried out before the start of the paper processing process by the sensor output abnormality detecting portion, and if it is detected that recovery to normal status has not been achieved even when the detecting process is carried out at a predetermined time after the start of the paper processing process, after the predetermined time, the transfer control portion suspends transfer of the at least one paper that is the objective of the paper processing process, and transfers the mock papers along a transfer route passing through the discriminating portion, and the sensor output abnormality detecting portion carries out a detecting process after the mock papers pass through the discriminating portion.

7. The paper processing device according to claim 1, wherein:

the sensor is a line sensor comprising a plurality of sensor devices arranged in a width direction crossing a paper transfer direction at the discriminating portion, and the sensor output abnormality detecting portion detects that the output of the sensor is in the specified abnormal status when a predetermined number of the sensor devices among the plurality of sensor devices is faulty.

8. The paper processing device according to claim 6, wherein:

for at least the detecting process carried out before the start of the paper processing process, the specified abnormal status is divided into a specified first abnormal status and a specified second abnormal status, and the sensor output abnormality detecting portion carries out the detecting process of the sensor output after the mock papers pass through the discriminating portion, and the transfer control portion starts the paper processing process when one of the first abnormal status and the normal status is detected in the initial detecting process carried out before the start of paper processing process by the sensor output abnormality detecting portion, while when the second abnormal status is detected in the initial detecting process, the transfer control portion transfers the mock papers along a transfer route passing through the discriminating portion prior to transferring the at least one paper that is the objective of the paper processing process.

9. The paper processing device according to claim 8, wherein:

the mock papers are longer with respect to a width direction crossing a transfer direction than the at least one paper that is the objective of the paper processing process, the sensor is a line sensor comprising a plurality of sensor devices arranged to a position exceeding a passing area of the at least one paper that is the objective of the paper processing process, in the width direction crossing the transfer direction; and the sensor output abnormality detecting portion detects that the output of the sensor is in the specified abnormal status when a predetermined number of the sensor devices among the plurality of sensor devices is faulty, and detects the status wherein all the sensor devices with faulty output are sensor devices in the passing area as the first abnormal status, and also detects the status wherein sensor devices out of the passing area are included in the sensor devices with faulty output as the second abnormal status.

10. A paper processing device having a discriminating unit to sense a passing paper with a sensor, and based on a result of the sensing, apply one of a plurality of predetermined discriminating results to each passing paper, and wherein for a process, at least one paper that is an objective of the process is transferred one by one along a transfer route that passes through the discriminating unit, and each paper's transfer route is changed after passing through the discriminating unit according to the discriminating result for the paper, the paper processing device comprising:

a sensor output abnormality detecting portion to detect whether an output of the sensor is in a specified abnormal status at a beginning of the process, and if the output of the sensor is in the specified abnormal status, also detect the output of the sensor during the process; and a transfer control unit to start the process, and when the sensor output abnormality detecting portion detects that the output of the sensor is in the specified abnormal status before the process begins, transfer papers through the discriminating unit to clean the sensor until a normal status is detected by the sensor output abnormality detecting portion, along a transfer route corresponding to the specified abnormal status, wherein the sensor is cleaned by transfer of paper, and sensor cleaning and the paper processing process are accomplished in parallel.

11. A paper processing device having a discriminating unit to sense a passing paper with a sensor, and based on a result of the sensing, apply one of a plurality of predetermined discriminating results to each passing paper, and wherein for a process, at least one paper that is an objective of the process is transferred one by one along a transfer route that passes through the discriminating unit, and each paper's transfer route is changed after passing through the discriminating unit according to the discriminating result for the paper, the paper processing device comprising:

a sensor output abnormality detecting portion to detect a status of an output of the sensor, that evaluates the output of the sensor at the beginning of the process, and if the status is not normal, evaluates the output of the sensor during the process; and a transfer control unit to start the process, and if the output of the sensor is one of normal and a first abnormal status, transfer at least one paper that is an objective of the process through the discriminating unit to clean the sensor and advance the process towards completion, and if the output of the sensor is a second abnormal status, transfer at least one paper through the discriminating unit to clean the sensor, and transfer at least one paper that is an objective of the process through the discriminating unit to advance the process towards completion, wherein the sensor is cleaned by transfer of paper, and sensor cleaning and the paper processing process are accomplished in parallel.

12. A paper processing device comprising:

a sensor output abnormality detecting portion to detect a status of an output of a sensor, that evaluates the output of the sensor at the beginning of a process, and if the status is not normal, evaluates the output of the sensor during the process; and a transfer control unit to transfer papers, wherein sensors are cleaned by the transfer of papers, and sensor cleaning and the process are accomplished in parallel.

* * * * *